US009211716B2

(12) United States Patent
Wall et al.

(10) Patent No.: US 9,211,716 B2
(45) Date of Patent: Dec. 15, 2015

(54) CAPPING DEVICE

(71) Applicant: VIDEOJET TECHNOLOGIES INC., Wood Dale, IL (US)

(72) Inventors: John Wall, Fairview Heights, IL (US); Thomas E. Kimerling, Corvallis, OR (US); Casey Robertson, Romeoville, IL (US); Martin McNestry, Heanor (GB); Julio Naveira, Collinsville, IL (US); David Doornink, Glen Carbon, IL (US); Kevin Kuester, Freeburg, IL (US); Anthony Selmeczy, Roselle, IL (US); Mark Waterman, Plainfield, IL (US); Stephen Cooke, Royston (GB); Graham Thomas, Girton (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 14/149,183

(22) Filed: Jan. 7, 2014

(65) Prior Publication Data

US 2014/0118438 A1 May 1, 2014

Related U.S. Application Data

(63) Continuation-in-part of application No. PCT/US2012/054771, filed on Sep. 12, 2012, which is a continuation-in-part of application No. 13/231,443, filed on Sep. 13, 2011, now Pat. No. 8,672,445.

(60) Provisional application No. 61/641,675, filed on May 2, 2012.

(51) Int. Cl.
*B41J 2/165* (2006.01)
*B41J 2/175* (2006.01)

(52) U.S. Cl.
CPC ..... *B41J 2/16505* (2013.01); *B41J 2/16535* (2013.01); *B41J 2/1752* (2013.01)

(58) Field of Classification Search
CPC ..... B41J 2/16505; B41J 2/16511
See application file for complete search history.

(56) References Cited

U.S. PATENT DOCUMENTS 5,444,474 A 8/1995 Ohtsubo
2004/0032450 A1 * 2/2004 Silverbrook ..... B41J 2/155 347/29

(Continued)

FOREIGN PATENT DOCUMENTS

EP 067273 9/1995
GB 2505883 A * 3/2014
JP 2007276394 A * 10/2007

OTHER PUBLICATIONS

Machine generated English translation of JP2007-276394, "Shutter Apparatus and Liquid Droplet Delivering Apparatus Equipped With This Shutter Apparatus" to Hori. Retrieved via https://www4.j-platpat.inpit.go.jp/eng/tokujitsu/tkbs_en/TKBS_EN_GM101_Top.action on May 12, 2015; 7pp.*

*Primary Examiner* — Shelby Fidler
(74) *Attorney, Agent, or Firm* — Joseph A. Yosick

(57) ABSTRACT

A capping device for an ink jet print head, includes a base, the base configured to receive an ink jet print head comprising nozzles for ejecting ink in a print direction, and a cap assembly attached to the base and configured for movement between a closed position when the print head is not printing and an open position to allow for the ejection of ink from the nozzles when the print head is printing. The cap assembly includes a cover support configured for generally planar movement with respect to the base in a direction perpendicular to the print direction and a cover attached to the cover support in a generally planar relationship thereto. The cover is adapted to provide additional movement with respect to the cover support in a direction different from the planar movement in the direction perpendicular to the print direction.

31 Claims, 19 Drawing Sheets

(56) References Cited

U.S. PATENT DOCUMENTS

2008/0192081 A1* 8/2008 Wheeler ..... B41J 2/16505 347/29
2009/0303299 A1 12/2009 Gilson
2013/0215189 A1* 8/2013 Justice et al. ..... 347/29

* cited by examiner

CAPPING DEVICE

CROSS REFERENCE TO RELATED APPLICATIONS

This application is a Continuation-in-part of PCT international application No. PCT/US12/54771, filed Sep. 12, 2012 which designates the U.S., which claims priority to U.S. application Ser. No. 13/231,443, filed Sep. 13, 2011 and to U.S. Provisional Application No. 61/641,675, filed May 2, 2012, all of which are incorporated herein by reference in their entireties.

BACKGROUND

The present disclosure relates to a capping device for an ink jet printer.

Thermal ink jet printers are commonly used to print on stationary substrates such as paper, as well as objects that may move past the print head such as cartons, boxes, and other types of primary and secondary packaging. A common problem with thermal ink jet printers is that when the print head is not being used, inks tend to dry out and clog the nozzles of the print head. A common approach to prevent this nozzle clogging has been to use some sort of capping device to seal the area around the nozzles. Prior devices frequently use a non-contact, molded or machined pocket over the nozzle orifices. In these designs, the pocket around the nozzle orifices needs to remain saturated with fluid to remain non-drying, and any deviation from planarity between the cap and the pocket allows air into the pocket which causes drying of the fluid and loss of print capability. Other prior devices, particularly those used for desktop printers, require the print head to be moved to a maintenance station when not printing. This requires additional components to move the print head and slows the process of capping and decapping.

BRIEF SUMMARY

The present disclosure provides a capping device for an ink jet printer that provides a cover for directly engaging the nozzle area of the print head to reduce solvent evaporation of the print head nozzles and minimize blocking and clogging of the print head nozzles. The device allows the print head to print after a capped period with minimal loss of print quality. The disclosed device is also capable of automatically capping and de-capping at high speeds to avoid missing print on the product each time the production line is stopped and started and during periods when no product is detected. The disclosed device is also an improvement over maintenance style caps, as the print head does not need to move from its printing position, thus allowing for faster capping and de-capping times.

In one aspect, a capping device for an ink jet print head includes a base, the base configured to receive an ink jet print head comprising nozzles for ejecting ink in a print direction, and a cap assembly attached to the base and configured for movement between a closed position when the print head is not printing and an open position to allow for the ejection of ink from the nozzles when the print head is printing. The cap assembly includes a cover support configured for generally planar movement with respect to the base in a direction perpendicular to the print direction and a cover attached to the cover support in a generally planar relationship thereto. The cover is adapted to provide additional movement with respect to the cover support in a direction different from the planar movement in the direction perpendicular to the print direction.

In another aspect, a method of operating a capping device for an ink jet print head includes providing a base, the base configured to receive an ink jet print head. A cap assembly includes a cover support and a cover attached to the cover support in a generally planar relationship thereto. The cap assembly is moved in a sliding movement with respect to the base to provide a closed position of the cap assembly when the print head is not printing and an open position to allow for the ejection of ink from nozzles when the print head is printing. The cover is moved in a direction different from the sliding direction and engages a surface of the cover with a surface of the print head adjacent the nozzles.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
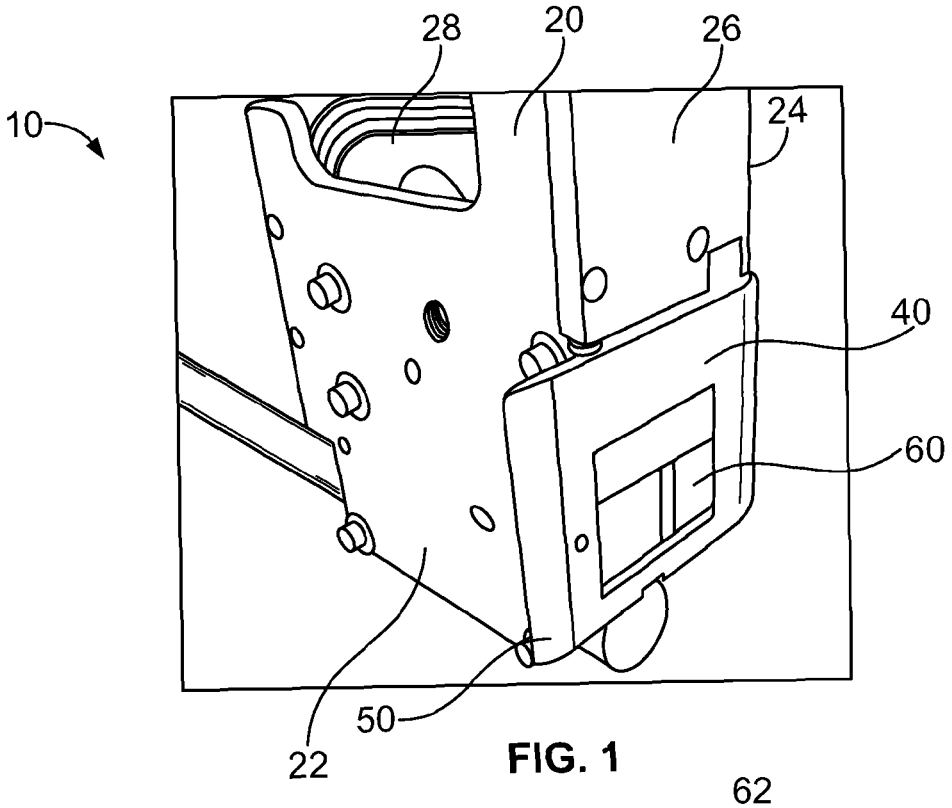
FIG. 1 shows a first embodiment of a capping device.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides a capping system for an ink jet printer. In particular, it provides a capping system for a thermal ink jet printer that covers the nozzle array when the printer is not printing to prevent the nozzles from drying out. The capping system provides a floating cover that provides a rigid surface to contact and seal the nozzle array when the printer is not printing.

A first embodiment of the capping device 10 is shown in FIG. 1. The capping device 10 includes a pocket or base 20. The base 20 is configured to receive an ink cartridge 28 with an ink jet print head 30 (not shown). The ink jet print head 30 is adapted to eject ink droplets in a controlled manner to print an image on a substrate. The ink cartridge 28 may include an ink reservoir. The base 20 serves as a holding device for the print head 30 and may include various electrical connections and the like for controlling operation of the cartridge 28. The base 20 generally includes side walls 22, 24 and bottom wall or face plate 26. It should be noted that the direction 'bottom' is used for convenience and the bottom wall 26 may be oriented in a side or other direction. An example of a print head and a base are described in U.S. Pat. No. 8,091,993B2, titled "INK CONTAINMENT SYSTEM AND INK LEVEL SENSING SYSTEM FOR AN INKJET CARTRIDGE," the contents of which are incorporated by reference herein. However, the capping systems as described herein is suitable for use with a variety of printing systems, and are particularly useful for thermal ink jet print heads, particularly those using organic solvent-based inks. It may also be used with print heads using aqueous inks or inks including mixtures of both solvents and water.

Figure 2:
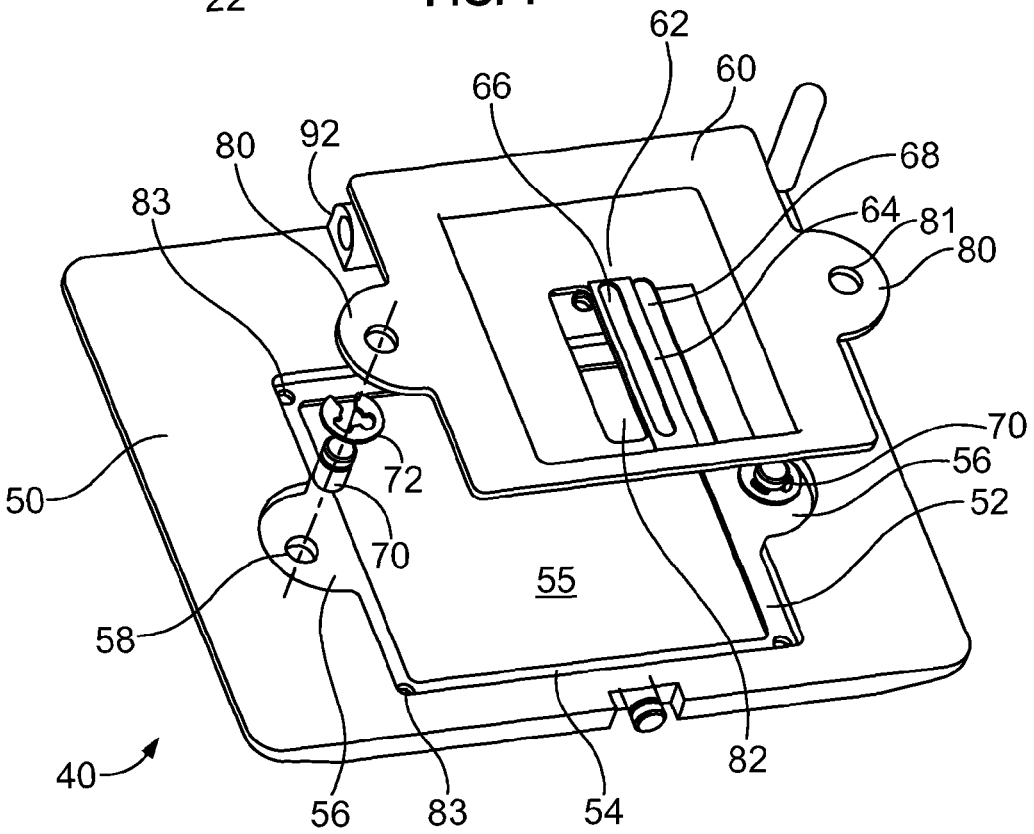
FIG. 2 is a partially exploded perspective view of the back side of an embodiment of a cap assembly.

As shown in FIGS. 1 and 2, a cap assembly 40 is attached to the base 20. The cap assembly 40 includes a cover support 50 configured for sliding movement with respect to the base 20 to provide a closed position when the print head 30 is not printing and an open position to allow for the ejection of ink when the print head 30 is printing. A cover 60 is attached to the cover support 50 in a generally planar relationship thereto. The cover 60 includes a rigid mating or engagement surface 62 to engage a portion of the print head 30. Mating surface 62 may be made from a rigid material such as metal; in particular, steel, especially stainless steel, is preferred. In particular, when the cap assembly 40 is in a closed position, the mating surface 62 seals the nozzles of the print head 30 to slow or prevent drying of the ink and subsequent blocking or plugging of the nozzles by the dried ink.

FIG. 2 shows the back side (side facing the print head 30) of cap assembly 40. Cover support 50 may be generally rectangular in shape. Disposed within cover support 50 is an inner frame 52. The inner frame 52 serves as an engagement surface for cover 60 and corresponds in shape to cover 60. In particular, inner frame 52 includes an indented ledge 54 disposed around the periphery of an opening 55, and semicircular areas 56 with holes 58 disposed at opposite sides of the opening 55. Ledge 54 and semicircular areas 56 are configured to correspond to the shape of cover 60 and accommodate the cover 60 thereto. Posts 70 are disposed in holes 58, and along with clips 72 serves to secure cover 60 to cover support 50. Cover 60 is capable of sliding up and down on posts 70 with respect to cover support 50, thus providing limited travel in the print or ink ejection direction during opening and closing of the cap assembly 40. The cover 60 includes a print window 82 for positioning over nozzles of the print head 30 when the capping device 10 is in an open or print position.

Cover 60 may include semicircular tabs 80 with holes 81. Tabs 80 preferably correspond in shape to semicircular areas 56. Posts 70 may be inserted in and affixed to holes 81. This connection allows the cover 60 to provide movement in a direction different from the sliding direction. The direction different from the sliding direction may be generally perpendicular to the sliding direction. The cover 60 may move a distance in the perpendicular direction that is small relative to the movement in the sliding direction. For example, the distance traveled by the cover in the perpendicular direction may be less than 25%, 20%, or 15% of the distance traveled by the cover 60 in the sliding direction. In one embodiment, the movement in a direction different from the sliding direction is rotational movement with respect to the cover support 50, as will be described in more detail below. The cover 60 may further be attached to the cover support 50 by at least one spring 85 (seen in FIGS. 5-7). The springs 85 may be attached to holes 83 in the corners of inner frame 52 and thence to the corresponding corners of cover 60. Springs 85 bias the cover 60 away from the cover support 50 and thus toward the print head 30. Cover 60 is capable of sliding up and down on posts 70 with respect to cover support 50.

Figure 3:
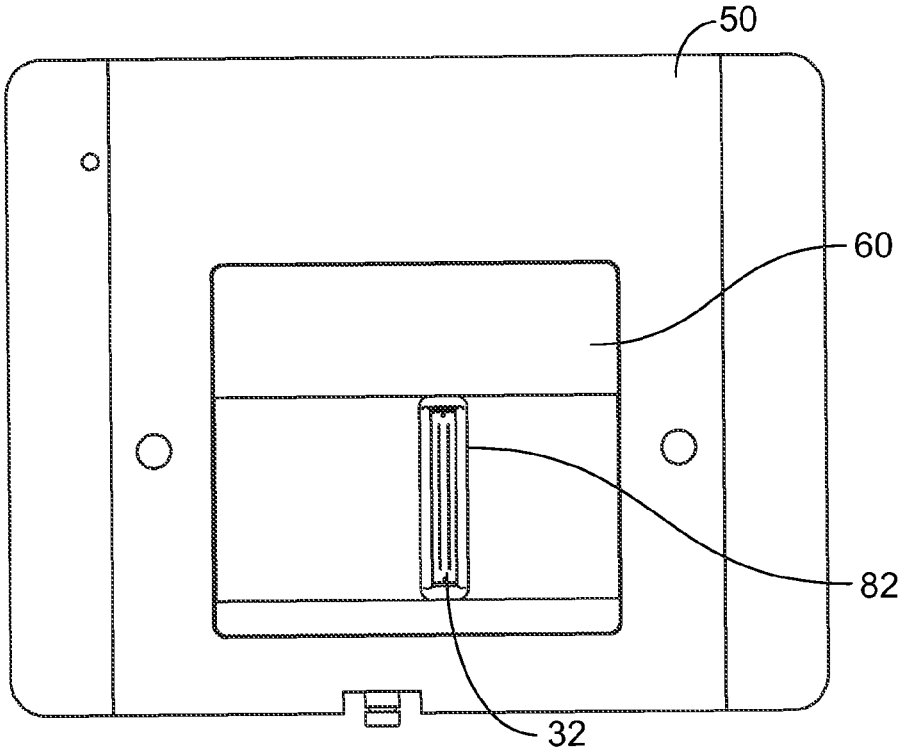
FIG. 3 is a view of the cap assembly of FIG. 2 in an open position.
Figure 4:
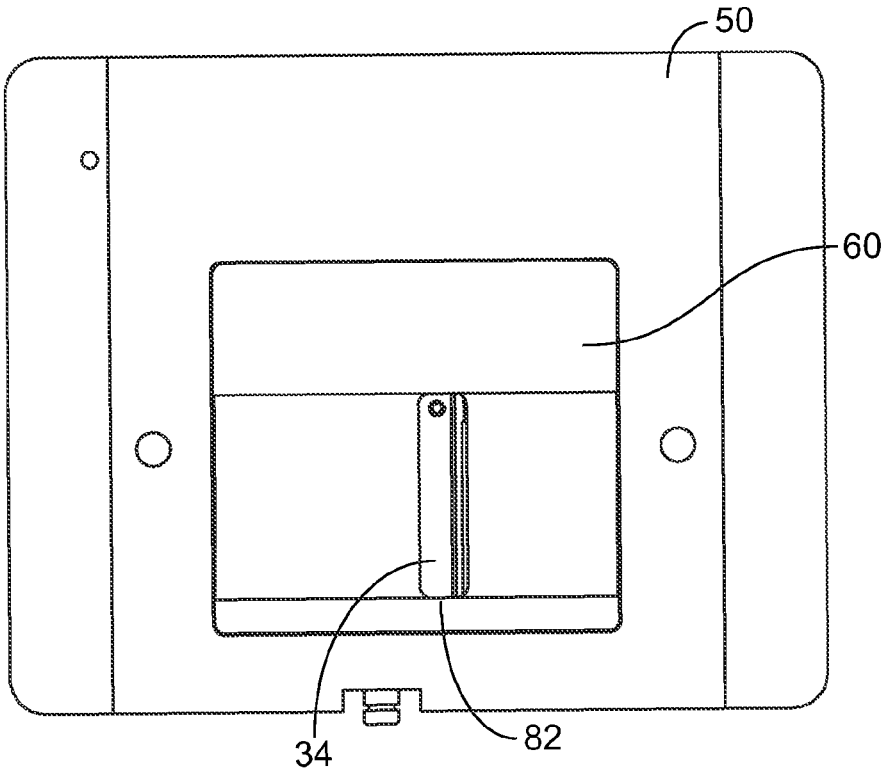
FIG. 4 is a view of the cap assembly of FIG. 2 in a closed position.

The cover 60 is disposed generally parallel to a nozzle surface (a surface adjacent the nozzles) of the print head 30 when the cap assembly 40 is an open and closed position. FIG. 3 shows the cap assembly 40 in an open position and FIG. 4 shows the cap assembly 40 in a closed position. In FIG. 3, the nozzle array 32 of the print head 30 can be seen through the window 82 in cover 60. As the cap assembly 40 is moved in a lateral (left-to-right) direction (perpendicular to the nozzle ejection directions) in FIG. 4, it can be seen that the nozzle array 32 is no longer exposed in window 82. Instead, a portion of the print head face 34 adjacent to the nozzle array 32 is visible through the window 82. In a preferred configuration, the lateral movement of cap assembly 40 (including cover 60) with respect to base 20 may be in the range of about 0.1 to 0.5 inches, preferably less than 0.5 inches, and more preferably less than 0.25 inches.

Figure 5A:
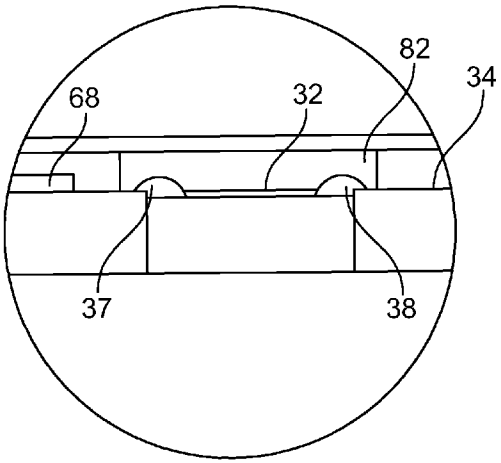
FIG. 5A is an enlarged view of the cap of FIG. 5.
Figure 6A:
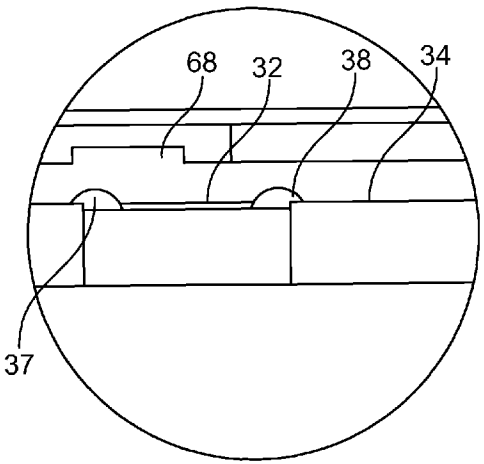
FIG. 6A is an enlarged view of the cap of FIG. 6.
Figure 5:
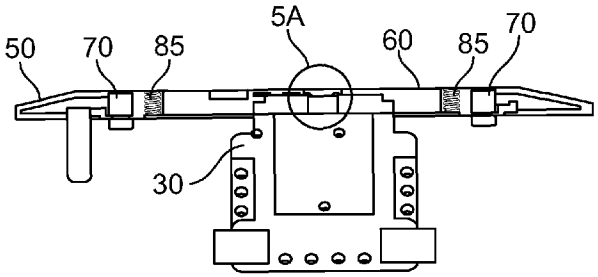
FIG. 5 is a sectional view showing the cap of the capping device of FIG. 1 in an open position.
Figure 6:
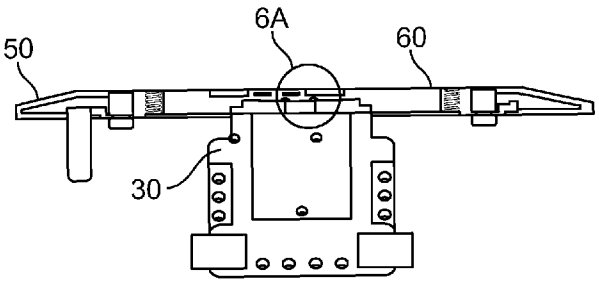
FIG. 6 is a sectional view showing the cap of the capping device of FIG. 1 between an open position and a closed position.

As shown in FIGS. 2, 5, 5A, 6, 6A, 7, and 7A, the mating surface 62 of cover 60 includes features to engage the print head 30. When the cap assembly 40 is in the open position, as shown in FIG. 5A, nozzle array 32 is disposed in window 82. Print head 30 is capable of ejecting ink in a print direction from nozzles array 32 through the window 82. Ridges or beads 37, 38 may flank the length of nozzle array 32. FIGS. 6 and 6A show the cap assembly 40 between an open and closed position. Cover 60 is disposed farther away from the face 34 of the print head 30 in this position, than when the cover 60 is in the fully open or fully closed position, to allow clearance over features of the print head face 34, including nozzle array 32.

Figure 7A:
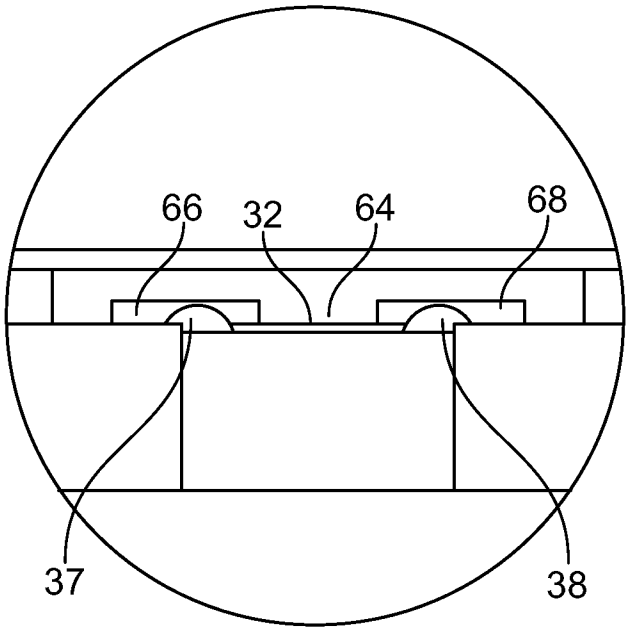
FIG. 7A is an enlarged view of the cap of FIG. 7.
Figure 7:
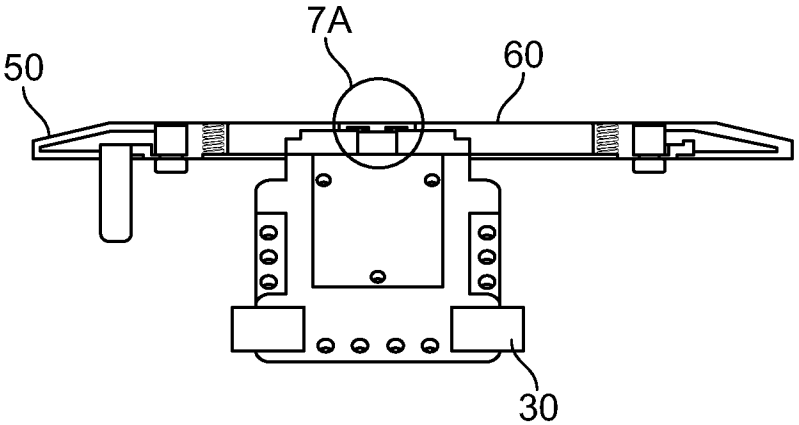
FIG. 7 is a sectional view showing the cap of the capping device of FIG. 1 in a closed position.

FIGS. 7 and 7A show the cover 60 in a closed position. As best seen in FIG. 7A, in one embodiment, the mating surface 62 includes a ridge 64 for directly covering the nozzle array 32 of the print head 30. As also seen in FIG. 2, the ridge 64 may be framed by slots or channels 66, 68. Slots 66, 68 are shallow elongated depressions that are configured to engage features on the face of the print head. In one embodiment, when the cap assembly 40 is in the closed position, ridge 37 is disposed in slot 66 and ridge 38 is disposed in slot 68; thus, slot 66 engages ridge 37 on the print head and slot 68 engages ridge 38 on the print head, with ridge 64 preferably directly touching nozzle array 32.

Ridges 37, 38 of print head 30 are disposed adjacent to the print window 82 when the cap assembly 40 is in the open position. With horizontal movement of the cover 60, ridges 37, 38 may urge the cover 60 generally upward (or in the ink projecting direction) during movement between the open and closed positions. The movement of cover 60 in the ink projecting direction with respect to base 20 may be in the range of about 0.01 to 0.05 inches, preferably less than 0.05 inches, and more preferably less than 0.04 inches. Thus, the movement of the cover 60 in the ink projecting direction is generally small (around 10% to 30%) relative to the horizontal movement of the cover 60 with respect to the base 20. Channels 66, 68 accommodate features of the print head 30. In particular, the channels 66, 68 engage the print head features 37, 38 when the cap assembly 40 is moved between an open position and a closed position. The springs 85 between the cover 60 and the cover support 50 bias the cover 60 toward the print head 30 so the cover 60 is substantially flush with the face 34 of the print head 30 when in the closed position.

The biased connection between cover 60 and cap assembly 40 allows the cover 60 to float with respect to the print head 30 to adjust the planar relationship between the cover 60 and the surface of the print head 30; thus, any slight imperfection in alignment between the cover 60 and print head 30 does not prevent a good seal from forming, because the planarity of cover 60 adjusts with respect to the print head 30 to provide for such imperfections. The rigid mating surface 62 is configured to directly engage a surface of the print head 30. The rigid mating surface 62 preferably directly engage the surface of nozzle array 32. Thus, unlike prior art devices, it does not require a flexible or elastomeric material to seal the cover 60 against the nozzle array 32, or a saturated pocket surrounding the nozzle array 32.

Figure 8:
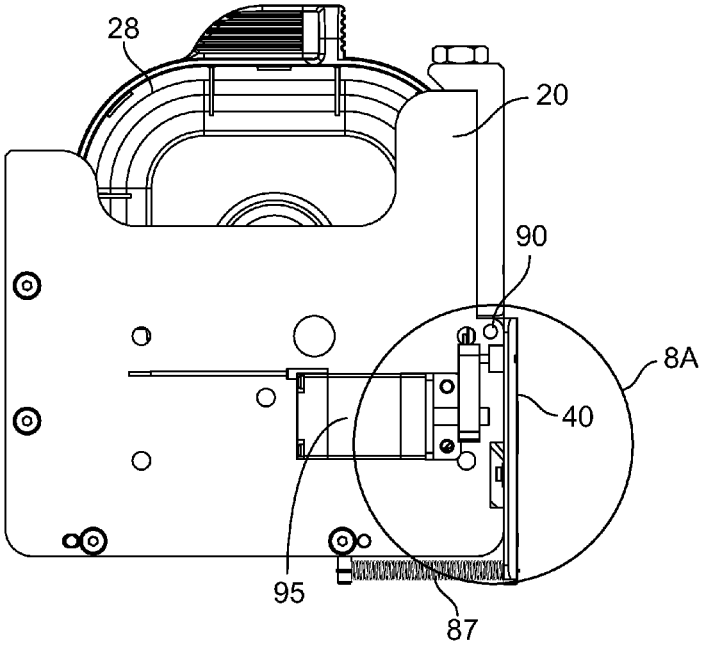
FIG. 8 is a sectional view showing the cap of the capping device of FIG. 1 in a closed position.
Figure 8A:
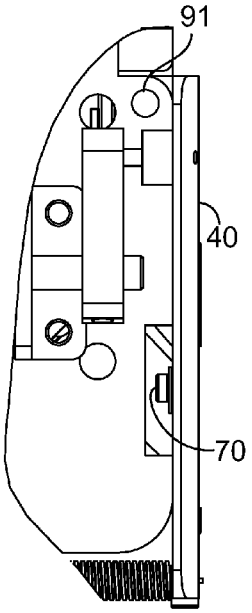
FIG. 8A is an enlarged view of the circled portion of FIG. 8.
Figure 9:
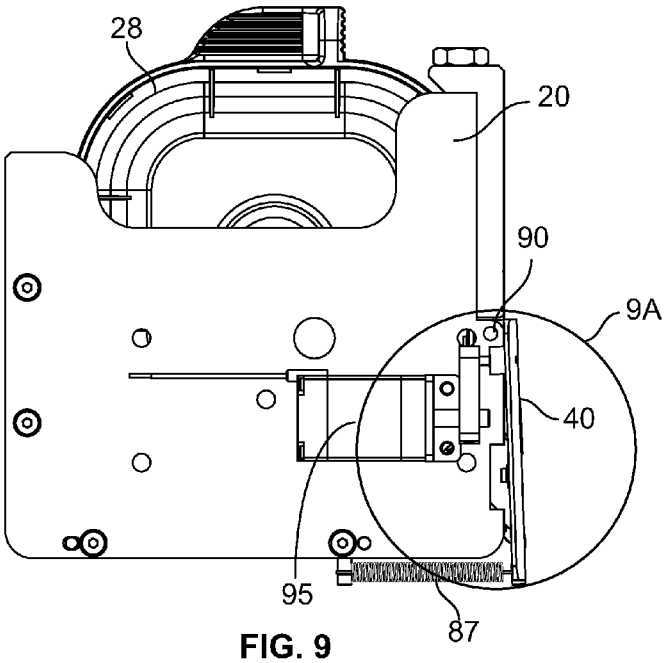
FIG. 9 is a sectional view showing the cap of the capping device of FIG. 1 between an open position and a closed position.
Figure 9A:
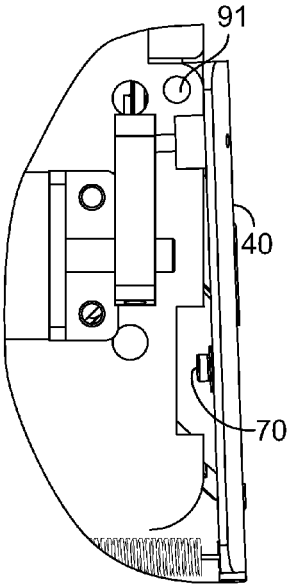
FIG. 9A is an enlarged view of the circled portion of FIG. 9.

The capping device 10 may include a mechanism for rotational movement of the cap assembly 40 with respect to the base 20. FIG. 8 is a side view showing the cap assembly 40 in a closed position and FIG. 9 shows the cap assembly between an open and closed position. As shown in FIGS. 8, 8A, 9, and 9A, cap assembly 40 includes a hinge 90. The hinge 90 may be any suitable design; in one embodiment, it includes pin 91 disposed in anchor portion 92 on cap assembly 40. A return spring 87 urges the cap assembly 40 towards the base 20. Hinge 90 permits the cap assembly 40 to rotate slightly with respect to the base 20 when moving between a capped and uncapped position, to prevent any damaging contact between the mating surface 62 and the print head face 34 or nozzle array 32. A ball detent may be used to lift the cap assembly 40 away from the base 20 during opening and closing of the cap assembly 40. This movement of the cap assembly 40 with respect to the base 20 between the open and closed position is preferably less than a 5°, 4°, 3°, or 2° angle of rotation of the cap assembly 40 with respect to the base 20. In one embodiment, this movement is about a 1° angle of rotation of the cap assembly 40 with respect to the base 20.

The cap assembly 40 may be controlled and moved or actuated by any suitable mechanism. In one embodiment, the assembly includes a drive mechanism 95 for actuating the cover support 50. The drive mechanism 95 may be similar to that disclosed below with respect to a second embodiment of a capping device.

Figure 10:
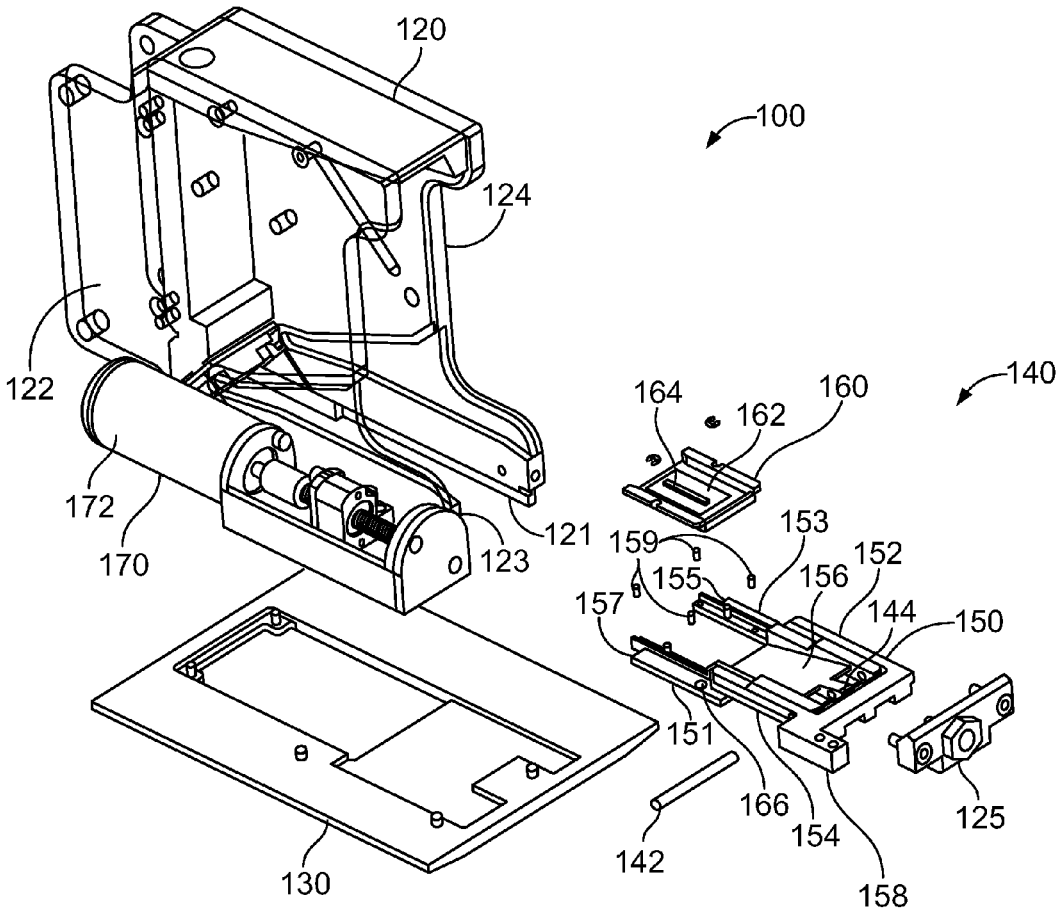
FIG. 10 is an exploded view of the components of a second embodiment of a capping device.
Figure 11A:
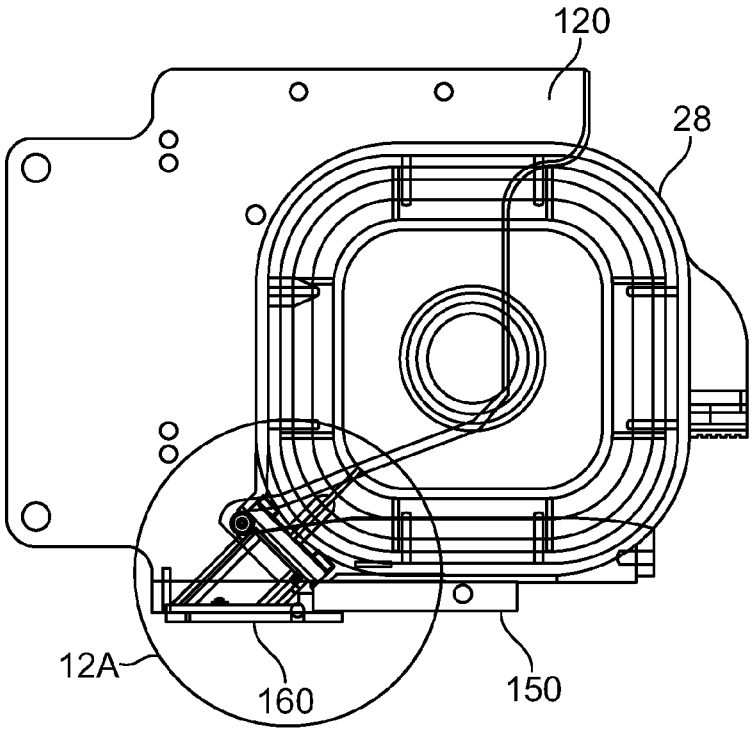
FIG. 11A is a sectional view of the second embodiment of the capping device in a closed position.
Figure 11B:
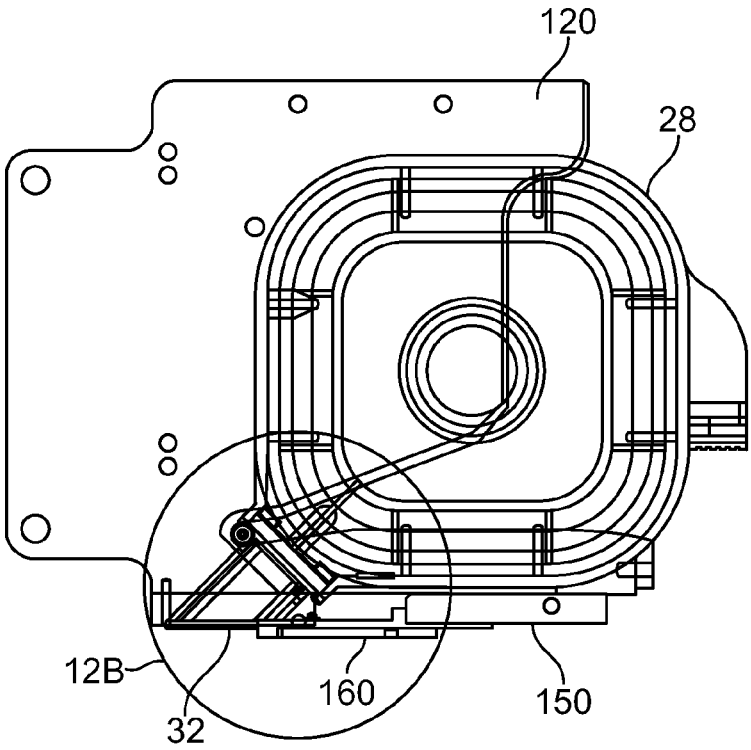
FIG. 11B is a sectional view of the second embodiment of the capping device in an open position

A second embodiment of the capping device 100 is shown in exploded view in FIG. 10. The capping device 100 includes a pocket or base 120. The base 120 is configured to receive an ink cartridge 28 with an ink jet print head 30 (shown in FIGS. 11A and 11B). Like base 20, base 120 also serves as a holding device for the print head 30 and may include various electrical connections and the like. The base 120 generally includes side walls 122, 124, face plate 130, and end plate 125. As shown in FIG. 10, a cap assembly 140 is attached to the base 120. The cap assembly 140 includes a cover support 150 configured for sliding movement with respect to the base 120 to provide a closed position when the print head 30 is not printing and an open position to allow for the ejection of ink when the print head 30 is printing. Cover support 150 may be generally U-shaped with arms 152 and 154 extending around cap frame 156. Cap frame 156 includes arms 151 and 153 and is hingedly attached to cover support 150. In one embodiment, pin 142 extends through portions of cover support 150 and end of cap frame 156 to provide the hinged connection. The cap assembly 140 includes a biasing mechanism 144 for urging the cover 160 towards or away from the print head 30. Biasing mechanism 144 may be one or more return springs. In one embodiment, biasing mechanism 144 allows the cap assembly 140 to be pushed slightly away from the print head when a cartridge is inserted into the base 120, while allowing the cover 160 to be in a closed position.

A cover 160 is attached to the cover support 150 at arms 151 and 153 and is in a generally planar relationship with respect to the cover support 150. Springs 159 or other biasing mechanisms are disposed between cover 160 and cover support 150 to allow the cover to float with respect to the cover support 150. The biased connection between cover 160 and cover support 150 preferably allows the cover 160 to float with respect to the print head 30 to adjust the planar relationship between the cover 160 and the surface of the print head; thus, any slight imperfection in alignment between the cover 160 and print head 30 does not prevent a good seal from forming, because the planarity of cover 160 adjusts with respect to the print head 30 to provide for such imperfections. The cover 160 includes a rigid mating or engagement surface 162 to engage a portion of the print head 30. In particular, when the cap assembly 140 is in a closed position, the mating surface 162 seals the nozzles of the print head 130. Mating surface 162 may include a ridge 164 adapted to contact the nozzle array 32.

Figure 12A:
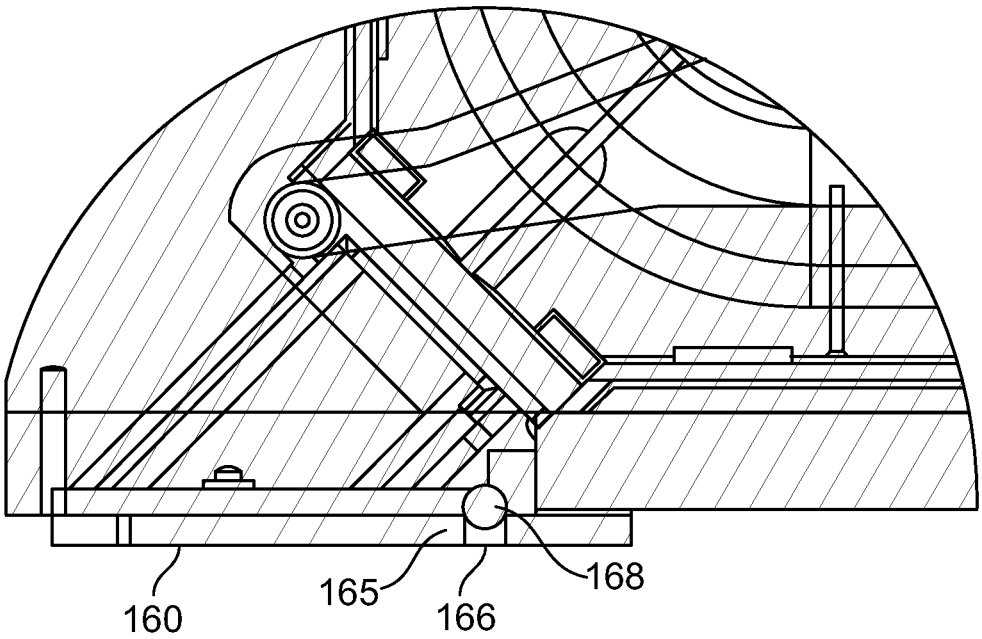
FIG. 12A is an enlarged view of area 12A of FIG. 11A.
Figure 12B:
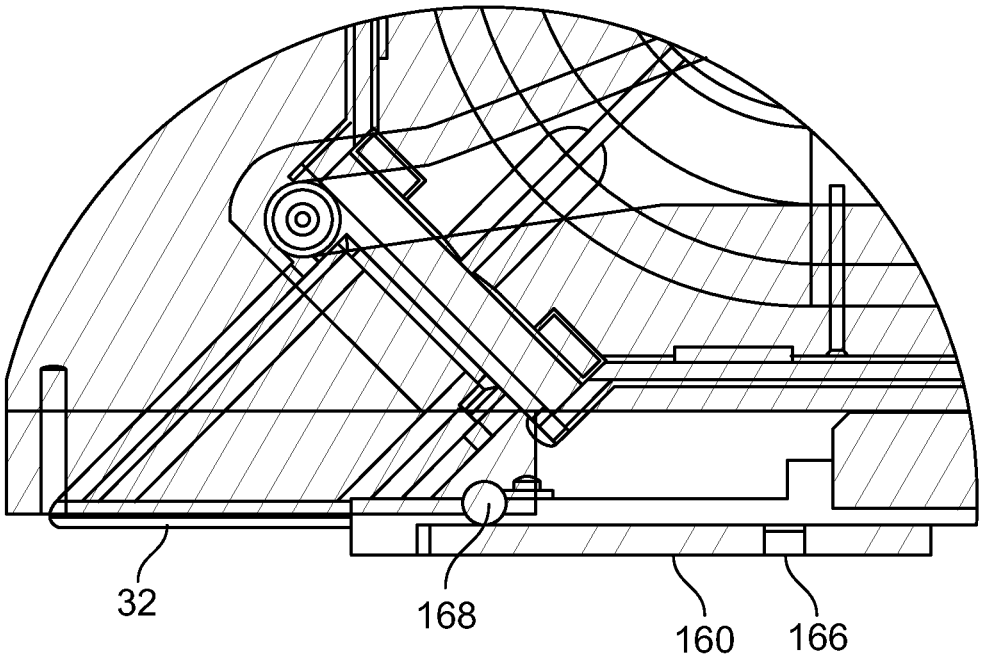
FIG. 12B is an enlarged view of area 12B of FIG. 11B.

The biasing mechanism 144 rotates the cover 160 with respect to the cover support 150 when the cap assembly 140 is moved between an open position and a closed position. As shown in FIGS. 11A, 11B, 12A and 12B, in one embodiment, the cover support 150 and the base 120 include a detent system 165 with hole 166 and ball 168 for urging the cover 160 away from the base 120 when the cap assembly 140 is moved between an open position and a closed position. One or more ball detents 165 are mounted on a surface of the base 120 and engage a surface of the cover 160, when the cover 160 is moving between the open and closed positions. In particular, base 120 include at least one ball 168 adjacent the portion of the base 120 that contacts cover 160 and cover 160 includes a corresponding aperture 166. As shown in FIG. 12A, in the closed position, ball 168 is in mating relationship with the aperture 166, and the spring 144 biases the cover 160 towards the print head. As shown in FIG. 12B, when the cover 160 is moved to the open position, ball 168 urges the cover 160 slightly downward and at angle with respect to base 120.

Figure 13A:
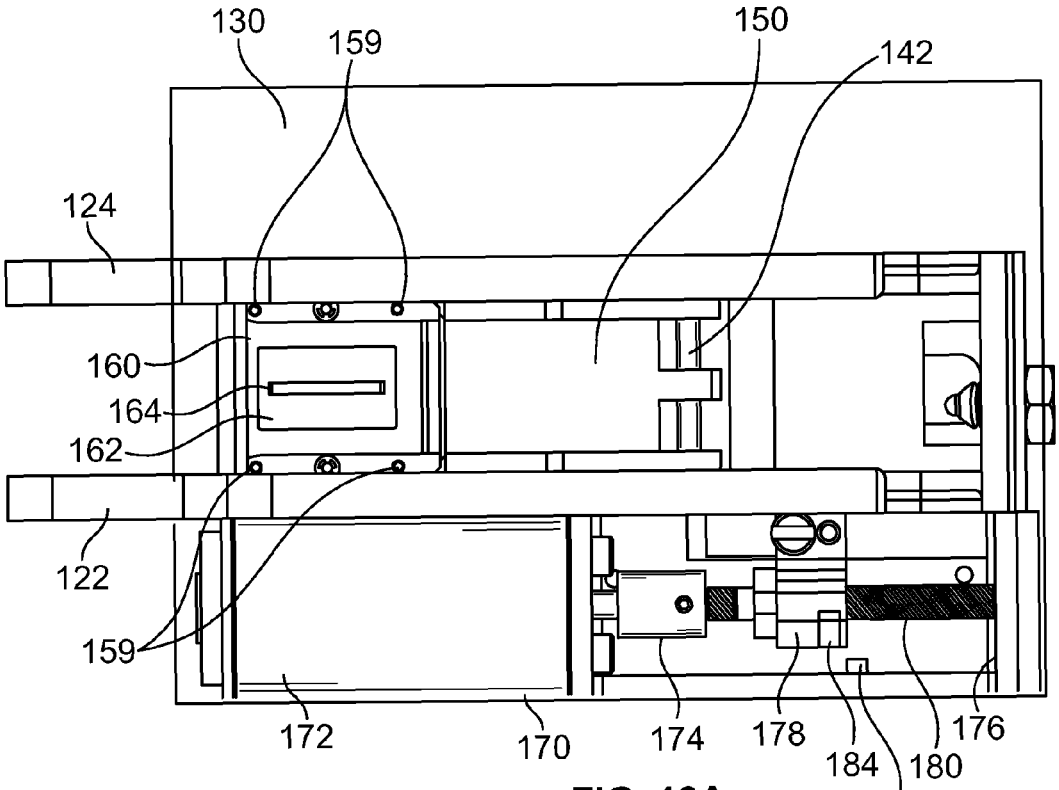
FIG. 13A is a top view showing the cap of the capping device of FIG. 10 in a closed position.
Figure 13B:
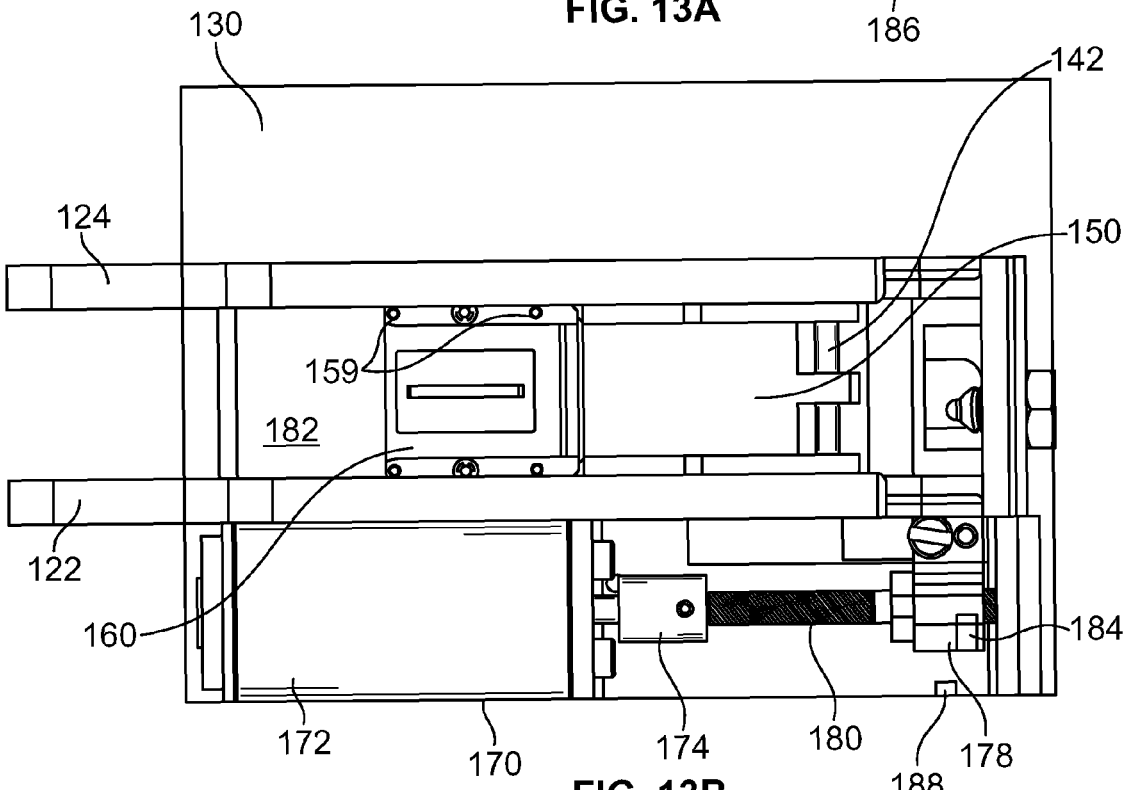
FIG. 13B is a top view showing the cap of the capping device of FIG. 10 in an open position.

The base 120 or face plate 130 and cover support 150 include a slide mechanism to enable the cover support 150 and cover 160 to slide with respect to the base 120 and print head 30. In one embodiment, cover support 150 includes flanges 155, 157 adjacent arms 151, 153, which extend laterally from the cover support 150 and are configured to be disposed in channels 121, 123 in base 120. Other mechanical arrangements are of course possible to permit the cover support 150 to slide with respect to the base 120, such as rails, channels, arms, rack and pinion, and the like. As shown in FIGS. 13A and 13B, the assembly may include a drive mechanism 170 for actuating the cover support 150. The drive mechanism may include a motor 172 for causing sliding movement of the cover support 150. The motor may be a DC synchronous motor, but any suitable motive force may be used, such as a stepper motor, a pneumatic system, or a solenoid. Motor 172 turns screw 180 which causes linear movement of driver 178, which is connected to cover support 150 via flange 158. Stops 174, 176 may be disposed at opposite ends of screw 180 to limit travel of the cover support 150 with respect to the base 120. In the open position, a window 182 is provided for ejection of ink form the print head 32 to a substrate. The device may include sensors or other features to determine the position of the cover 160. The sensor may be positioned along the travel path of the cover 160 itself, or adjacent other parts that move when the cover 160 is opened or closed. For example, the driver 178 may include a magnet 184 so that Hall effect sensors 186, 188 disposed along the path of travel of driver 178 can be used to determine the position of the cover 160. In particular, sensor 186 can determine a closed position and sensor 188 can determine an open position. In an alternative embodiment, a rotary encoder may be used with screw 180 to determine the position of cover 160. The sensors also may be used to control the speed of the opening and closing of the cover 160, in particular to slow down the speed during a portion of the opening or closing movement to minimize wear and tear on the mechanical components.

Figure 14:
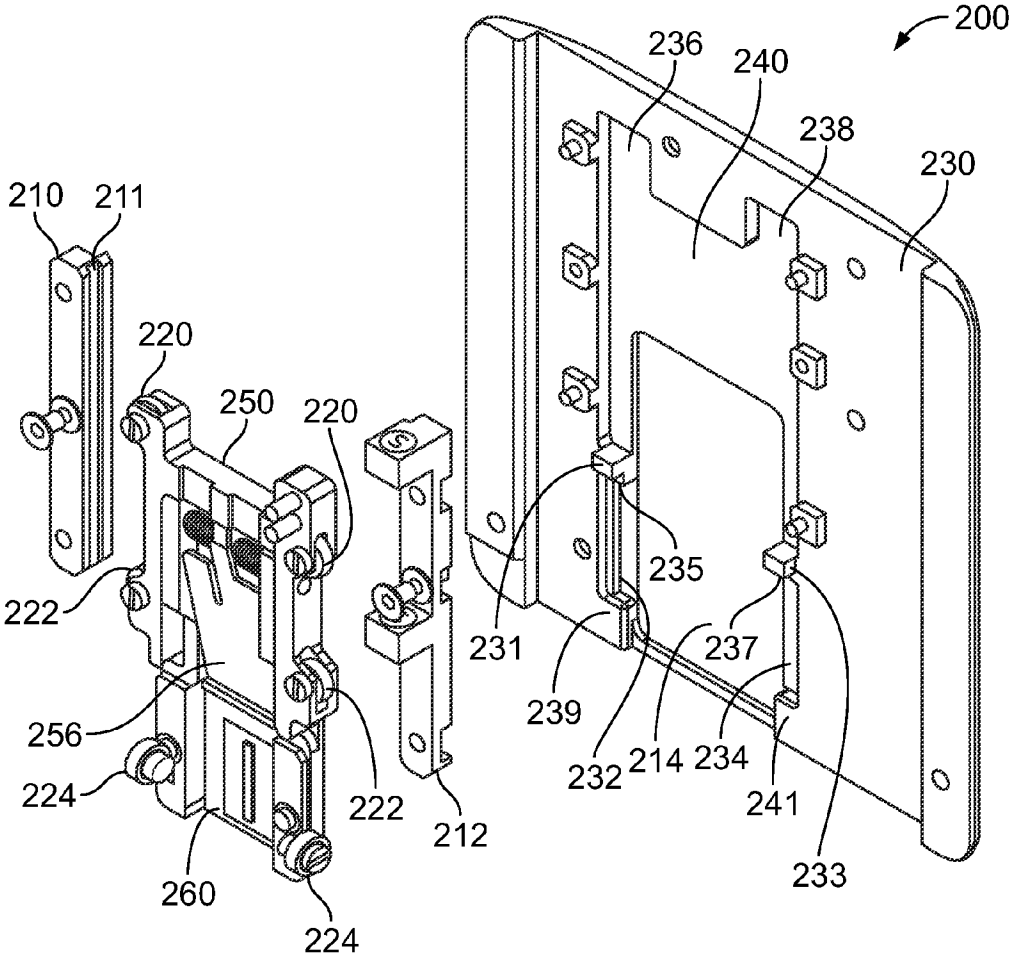
FIG. 14 is an exploded view of another embodiment of a capping device.
Figure 15B:
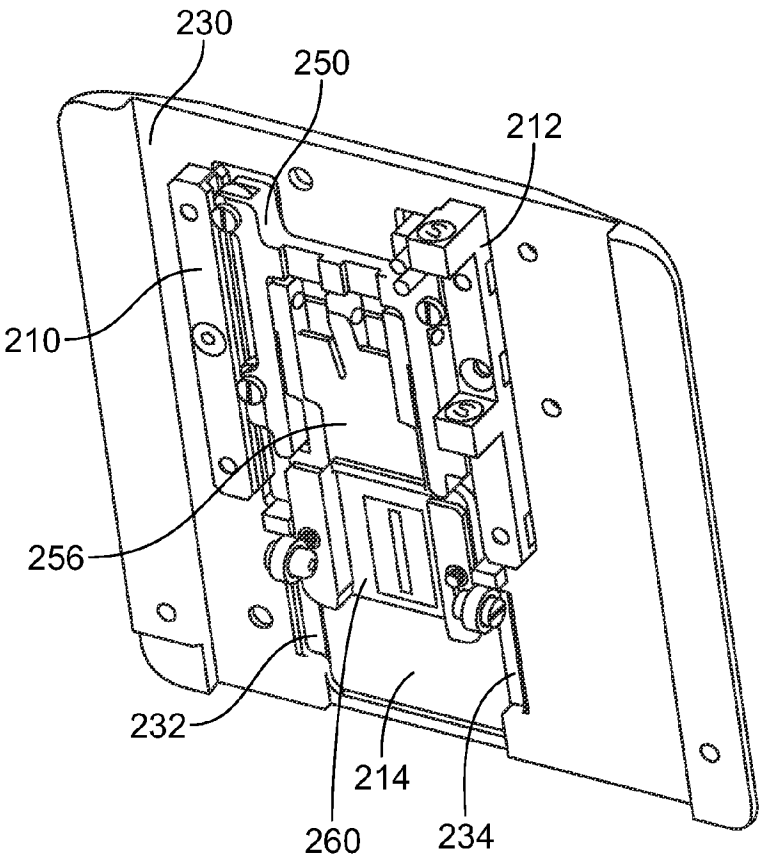
FIG. 15B is a perspective view of the capping device of FIG. 14 in an open position.
Figure 15A:
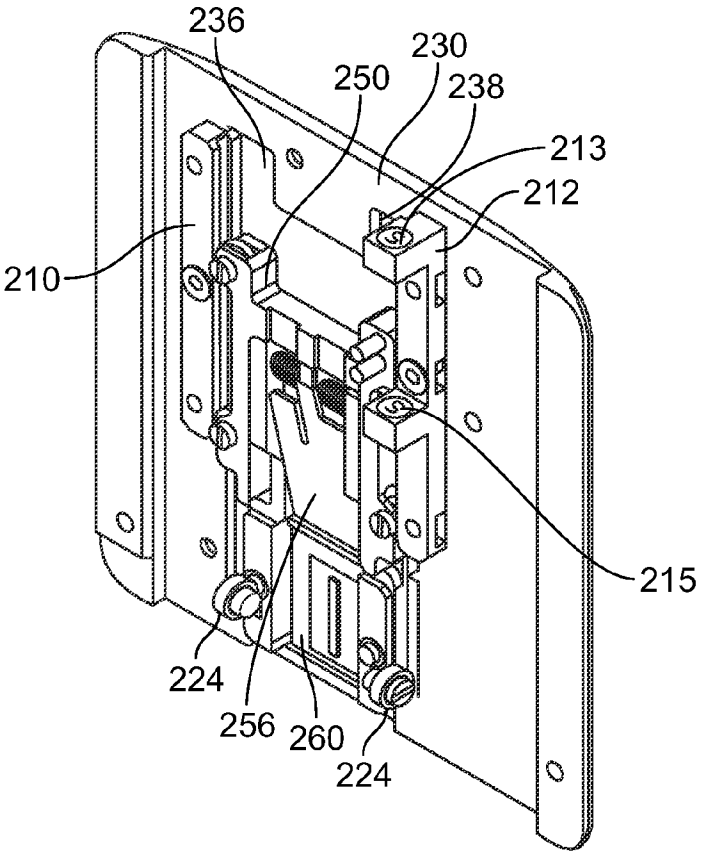
FIG. 15A is a perspective view of the capping device of FIG. 14 in a closed position.

FIG. 14 is an exploded view of another embodiment 200 of a cap assembly. FIG. 15A and FIG. 15B show the capping device in closed and open positions, respectively. In general, cap assembly 200 is similar to that shown in FIG. 10 but includes a different mechanism for allowing sliding or rolling of the cover support and cover. The cover support 250 may be generally U-shaped with arms extending around cap frame 256. The cover support 250 is configured for generally planar movement with respect to the base 120 or face plate 230 in a direction perpendicular to the print direction. A cover 260 is adapted to provide additional movement with respect to the cover support 250 in a direction different from the planar movement of the cover support. Cap frame 256 is hingedly attached to cover support 250.

Cap assembly 200 includes a first pair of rollers 220 and a second pair of rollers 222 that allow sliding or rolling movement of the cover support 250 with respect to the base 120 or face plate 230. Rollers 220, 222 are disposed in guide members 210 attached to face plate 230. Guide members 210, 212 are disposed on either side of opening 214 and include slots 211 that are engaged by rollers 220, 222. Guide members 210, 212 are secured to the face plate 230, either by fasteners or other means. Face plate 230 includes a recessed area 240 for containing portions of the cover support 250. Recessed area 240 includes tracks 236 and 238 providing space for rollers 220 and supporting portions of the cover support 250. Like the previous embodiments, springs or other biasing mechanisms are disposed between cover 260 and cover support 250 to allow the cover 260 to float with respect to the cover support 250. Guide member 212 may include magnets 213, 215 at either end. The magnets 213, 215 are attracted to corresponding magnets (not shown) in an adjacent portion of an arm connected to cover support 250. Magnets 213, 215 help to keep the cap assembly in the fully open and closed positions. In particular, the magnets 213, 215 help to keep the cover 260 in the proper location in the print direction (e.g., keep the cover 260 fully seated against the print head in the closed position).

Another pair of rollers 224 is disposed at the end of the cover support 250 and attached to the cap frame 256 adjacent the cover 260. Rollers 224 travel along guides 232, 234 in face plate 230 to provide rolling movement of the cap frame 256 with respect to the face plate 230 when the cover 260 is moved between an open position and a closed position. Stops 231 and 233 are disposed between guides 232, 234 and guides 236, 238 respectively. Stops 231, 233 limit the movement of the cover support 250 when the cap assembly 200 is moved to the open position.

It should be clear that cover support 250 generally moves in strictly one plane (perpendicular to the print direction) with respect to the base plate 230. In contrast, because cap frame 256 is hingedly attached to cover support 250, cap frame 256 and cover 260 move primarily in a direction perpendicular to the print direction, but also moves slightly in a direction parallel to the print direction when the cap assembly 200 is moved between the open and closed positions. In one embodiment, rollers 224 serve an additional function in providing movement in a direction parallel to the print direction. Stops 231, 233 may have shoulders 235, 237, and shoulders 239, 241 may be disposed at the opposite ends of guides 232, 234. Shoulders 235, 237, 239, 241 allow the cover 260 to be pushed out away from the print head at the extreme open and closed positions. The rollers 224 engage the shoulders 235, 237, 239, 241 to adjust the distance between the cover 260 and the print head. In particular, rollers 224 roll up from guides 232, 234 onto the shoulders 239, 241 in the closed position. Similarly, rollers 224 roll up from guides 232, 234 onto the shoulders 235, 237 in the open position. Magnets 213, 215 may help secure the cover 260 in the proper position when the cap assembly is fully open and fully closed. Thus, in the intermediate position between fully open and fully closed, the cover 260 is displaced slightly away from, and angled with respect to, the surface of the nozzle array.

As previously described, the cover 260 is adapted to provide additional movement with respect to the cover support 250 in a direction different from the planar movement of the cover support 250. The additional movement of the cover 260 with respect to the cover support 250 may be generally perpendicular to the rolling or sliding direction; in other words, it may be generally in the print or ink ejection direction. In one embodiment, this movement is at least partly rotational, such that the cover 260 is angled at an angle at least 0.5° or 1° and less than 3° with respect to the surface of the print head when the cover 260 is in an intermediate position between the open position and the closed position. The displacement of the cover 260 with respect to the print head may be less than 0.05 inches in the print direction, as compared between the intermediate position and the open position, or between the intermediate position and the closed position.

The cover 160 or 260 may include a variety of suitable surfaces for engaging the nozzle array of a cartridge. The cover is preferably sufficiently dimensionally malleable to adjust the planar relationship between the cover and the surface of the print head. Alternative designs for the cover 160/260 are shown in FIGS. 16-19. As will be described in further details below, any of the cover designs may use a spitting method to improve code recovery after capping. In particular, ink may be ejected from the nozzles while the cap assembly is in the closed position to provide a layer of ink between the nozzles and the surface of the cover.

Figure 16A:
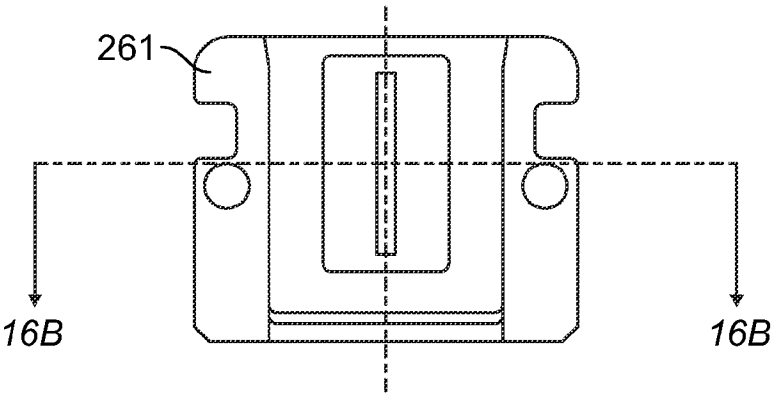
FIG. 16A is a top view of the cover of FIG. 16.
Figure 16C:
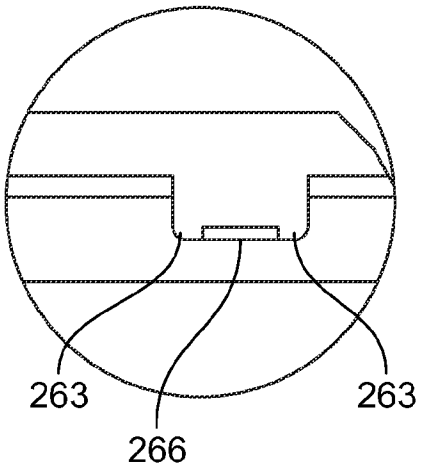
FIG. 16C is an enlarged view of detail 16C of FIG. 16B.
Figure 16:
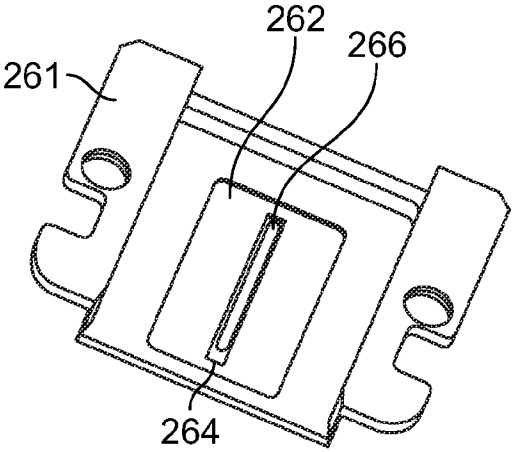
FIG. 16 is a perspective view of an embodiment of a cover.
Figure 16B:
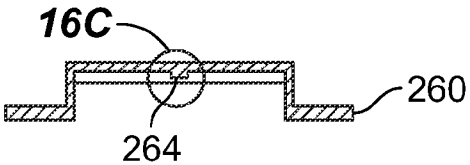
FIG. 16B is a view along line 16B-16B of FIG. 16A.

FIGS. 16 to 16C show a cover design with a cavity in the ridge. As in previous embodiments, the cover 261 includes a ridge 264 extending from a surface 262 and adapted to contact the nozzle array 32. Disposed along the length of the ridge 264 is a shallow cavity 266 defines by walls 263. In particular, cavity 266 may be about 0.005 inches deep. The walls 263 may correspond to perimeter around the nozzle area of the print head, such that the shallow cavity 266 is configured to be disposed over the nozzles. This configuration may provide in part the dimensional malleability of the cover 261. The cavity 266, which has a relatively small volume, may provide a "solvent rich" environment in the cap around the nozzle array to keep the printing orifices in optimal printing condition.

Figure 17A:
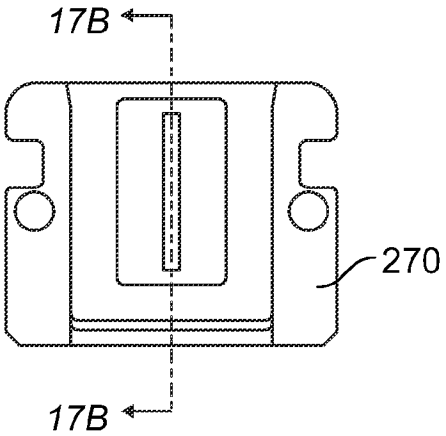
FIG. 17A is a top view of the cover of FIG. 17.
Figure 17C:
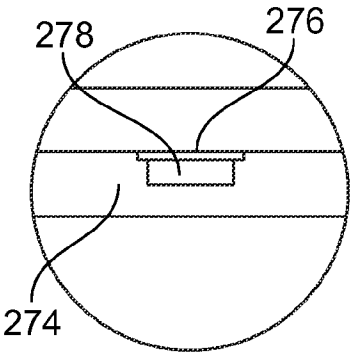
FIG. 17C is an enlarged view of detail 17C of FIG. 17B.
Figure 17:
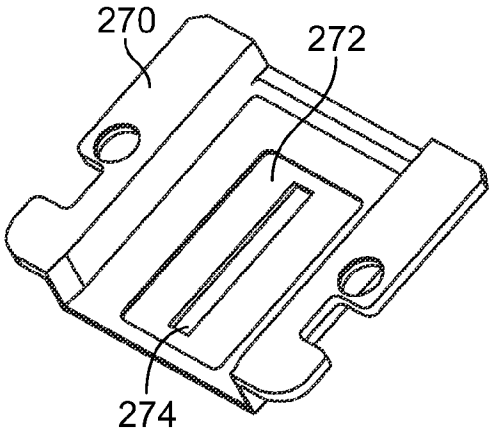
FIG. 17 is a perspective view of another embodiment of a cover.
Figure 17B:
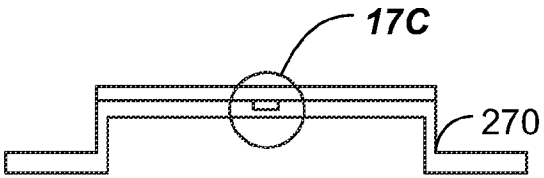
FIG. 17B is a view along line 17B-17B of FIG. 17A.

In one embodiment, the cap surface that engages the nozzle array includes both rigid and elastomeric materials. For example, the cap may include a layer of a relatively rigid material and an adjacent layer of a relatively flexible or elastomeric material. FIGS. 17 to 17C show a cover 270 with ridge 274 including an elastomeric material. As in previous embodiments, the cover 270 includes a ridge 274 extending from a surface 272 and adapted to contact the nozzle array 32. The ridge 274 is composed of two materials. A length of elastomeric material 276 is disposed adjacent the cap surface 272. Disposed on top of the elastomeric material 276 is a metal surface 278. The metal surface 278 is configured to be disposed adjacent the nozzle array. Thus the cover 270 surface includes a relatively rigid surface 278 configured to engage the nozzles, on top of a relatively flexible surface 276. The elastomeric layer may be about 0.005 inches thick and the metal layer 278 may be about 0.015 inches thick. This design provides an advantage in that a rigid metal surface contacts the nozzle array to provide a seal, but the elastomer provides some flexibility to allow adjustment of the contact of the cap surface to the nozzle array.

Figure 18A:
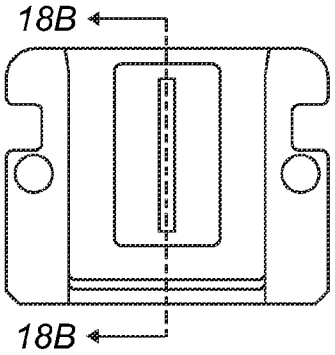
FIG. 18A is a top view of the cover of FIG. 18.
Figure 18C:
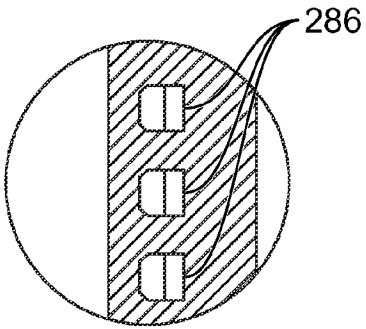
FIG. 18C is an enlarged view of detail 18C of FIG. 18B.
Figure 18:
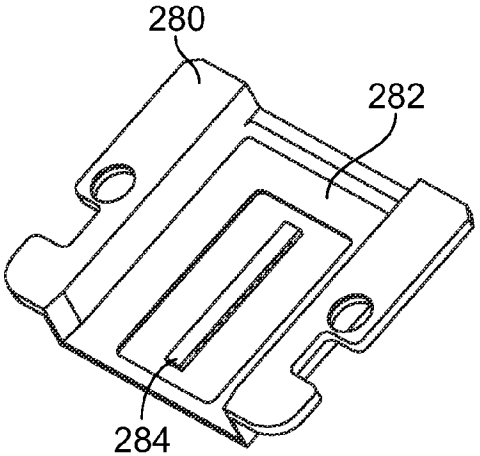
FIG. 18 is a perspective view of another embodiment of a cover.
Figure 18B:
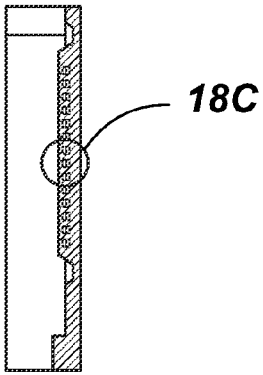
FIG. 18B is a view along line 18B-18B of FIG. 18A.

FIGS. 18 to 18C show a cover 280 with ridge 284 including an elastomeric material. As in previous embodiments, the cover 280 includes a ridge 284 extending from a surface 282 and adapted to contact the nozzle array 32. The ridge 284 is composed an elastomeric material with hollow cavities 286. The cavities 286 may be generally about 0.02 inches in height and depth, with about 0.02 inches of elastomeric material between adjacent cavities 286. This design provides an advantage that the elastomeric layer provides some flexibility to allow adjustment of the contact of the cap surface to the nozzle array, in that the elastic material is able to compress to provide in part the dimensional malleability of the cover 280.

Figure 19A:
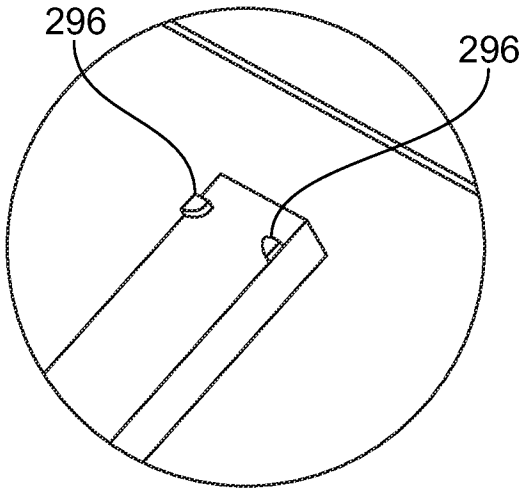
FIG. 19A is an enlarged view of detail 19A of FIG. 19.
Figure 19:
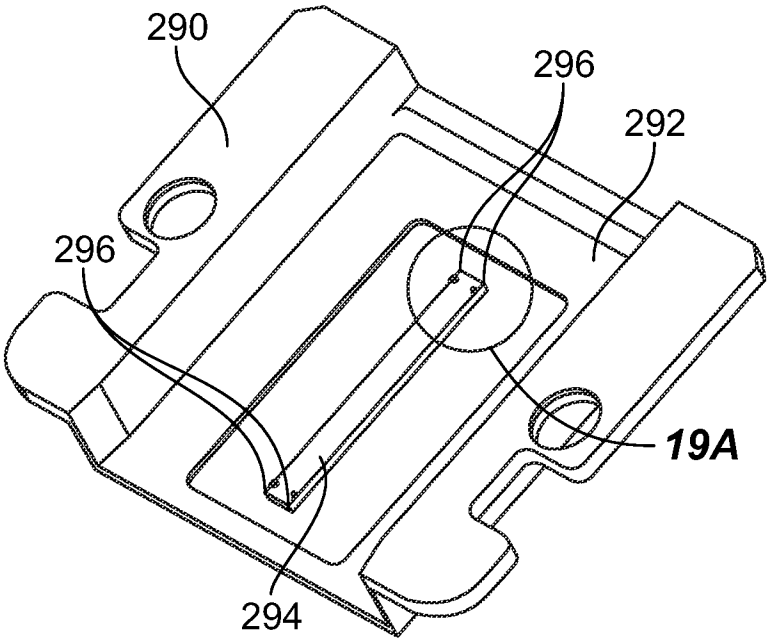
FIG. 19 is a perspective view of another embodiment of a cover.

FIGS. 19 and 19A show a cover 290 with ridge 294 extending from a surface 292 and adapted to contact the nozzle array 32. The ridge 294 includes protrusions 296 disposed at the corners of the ridge 294. The protrusions 296 may correspond to an area adjacent a nozzle array of the print head, such that the surface of ridge 294 is able to engage the nozzle array. Thus, although the surface of the ridge 294 is not completely flat, the presence of the protrusions does not prevent a suitable seal of the cover 290 against the nozzle array. Thus, the mating surfaces between the cover and the nozzle array do not need to be totally flat. The protrusions 296 contact the nozzle array to establish a gap between the nozzle array and the surface of the ridge 294. Within that gap there can be flatness variation but the gap is small such that the when ink will fill the void and create the seal, such as when used with a spitting method.

In other embodiments, any of the disclosed covers may be attached, for example, directly to the cap frame 156 or 256 without the use of spring to provide the floating movement. The cover is sufficiently dimensionally malleable to adjust the planar relationship between the cover and the surface of the print head.

Figure 20A:
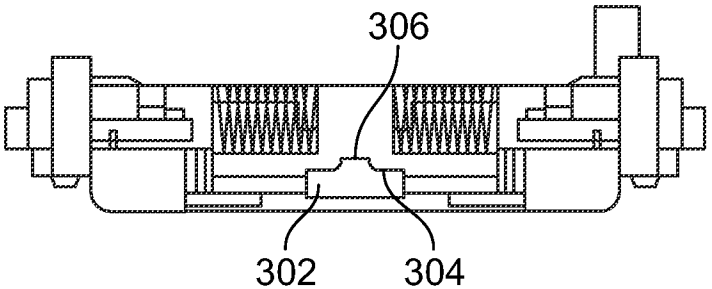
FIG. 20A is a side view of the cover of FIG. 20.
Figure 20:
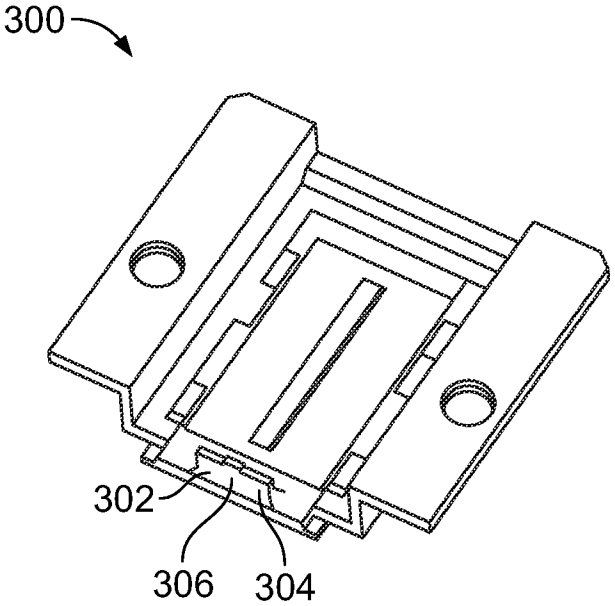
FIG. 20 is a perspective view of an embodiment of a cover with a wiper.

In one embodiment, the system includes a wiper mechanism for wiping the surface of the nozzle array or an area of the print head adjacent the nozzles. As shown in FIG. 20, an embodiment of a cover 300 includes a wiper 302 disposed at the distal end of the cap (i.e. at the end opposite the cover support 156 or 256). Wiper 302 includes extension 304 and tip 306. Tip 306 is configured to wipe the surface of the nozzle array to remove ink, debris and generally clean the nozzle array, when the cover 300 is moved open and closed. Wiper 302 is preferably made from a stiff elastomeric material. The wiper 302 may be between 0.1 inch and 0.5 in width and 0.05 inch and 0.2 in length.

Figure 21A:
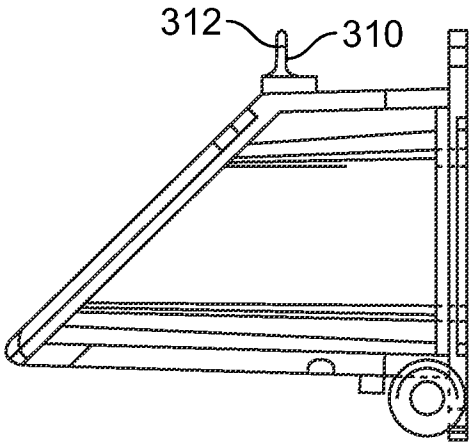
FIG. 21A is a side view of the print head of FIG. 21.
Figure 21:
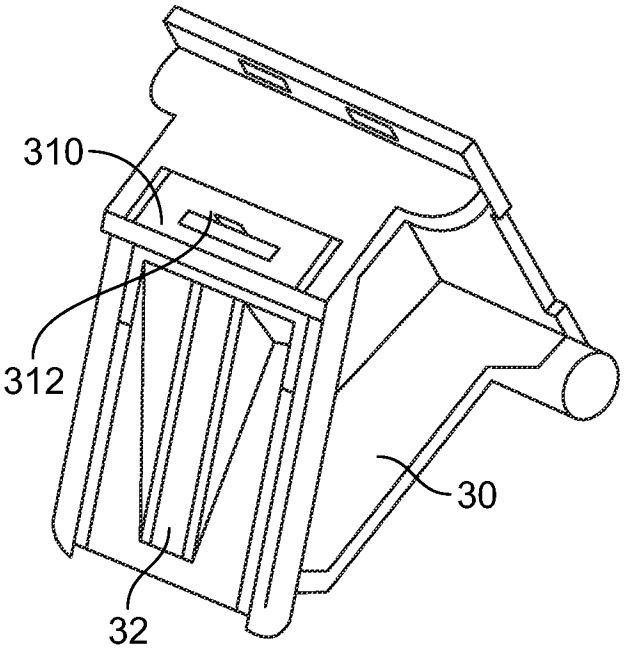
FIG. 21 is a perspective view of a print head with a wiper.

In another embodiment, the cartridge includes a wiper for wiping the surface of the cover that engages the nozzle array. Print head 30 is shown in FIG. 21. Attached to the print head 30 is a wiper mechanism 310. Wiper mechanism is attached to a portion of the print head 30 adjacent the nozzle array 32. Wiper mechanism 310 includes extending portion 312. The wiper mechanism 310 is configured to wipe the surface of the cover (such as ridge 164) to remove ink or debris, when the cover is moved between the open and closed positions.

The operation of cap assembly 100 may be provided by mechanisms known in the art, such as electronic controllers, computers, and the like. In one embodiment, the motor control system includes a programmable logic device, a direct-current motor (such as motor 172), a network of switches applying power to the motor, and limit switches near the ends of travel of the cap assembly (such as sensors 186, 188). The motor control algorithm may be implemented as a state machine in programmable logic. Whether open or closed, the state machine dwells in an idle state wherein the motor is not energized. When the controller sends a command to the motor state machine, the state machine stores the direction bit and a drive time parameter from the command. The state machine then checks the location of the cap against the limit switches, and it either proceeds to a state in which the motor is energized, if necessary, or remains in the idle state.

As previously noted, position sensors may be used to change the speed of the cap during opening and closing. For example, if the direction bit indicates opening, the state machine energizes the motor until the limit switch near the open position changes state. The state machine may then energize the motor by pulse width modulation to decrease the drive speed. After this time, it proceeds back to the idle state. If the direction bit indicates closing, then the state machine energizes the motor, unmodulated, for a period of time, and then proceeds to a fixed-duty pulse width modulation energization state until a change in the state of the limit switch near the closed position. The state machine then proceeds to a state in which it continues to drive the motor with pulse width modulation for a fixed period of time. After this time, it returns to the idle state. Of course, other variations of this method are possible, as well as other known methods to control the opening and closing of the cover 160.

The control may be integrated with a production line, for example, to providing closing of the cap assembly 100 when print head 30 is not being used for printing. Movement of the cap assembly 100 may also be integrated with various maintenance operations for the print head 30, such as spitting, wiping, and cleaning. In particular, as will be disclosed below, using a spitting operation on a cap assembly has been found to provide very good code recovery.

The disclosed capping devices 10 and 100 allow the print head 30 to print after a capped period with minimal loss of print quality. The disclosed devices are also capable of automatically capping and de-capping at high speeds to avoid missing print on the product each time the production line is stopped and started and during periods when no product is detected. The uncap time (defined as the time it takes for the capping device to move from a closed position to an open position) is preferably less than 100 milliseconds, 50 milliseconds, or 25 milliseconds. A printing system with the capping device can preferably print on a piece of media (such as a package) traveling at a speed of at least 5 ft/sec using a product detect sensor no further than 2 inches upstream of the print head. To achieve this, the uncap time needs to be about 35 milliseconds or faster. The disclosed embodiments were capable of achieving uncap and cap times of around 20 milliseconds, with typical uncapping times of about 35 milliseconds.

The disclosed devices do not need the print head to move from its printing position, thus allowing for faster capping and de-capping times. Although the disclosed embodiments are generally described with respect to a thermal ink jet print head, it is apparent that they may also be used with other types of printers, such as piezo based drop on demand printers and the like. The various components of the capping devices 10 and 100 may be made of any suitable material; stainless steel is a preferred material. Further, components and features disclosed with respect to one of the embodiments 10 and 100 may also be used with the other embodiment. By way of example, drive mechanism 170 (including sensors 186, 188) may be used with capping device 10, and so forth.

Figure 13C:
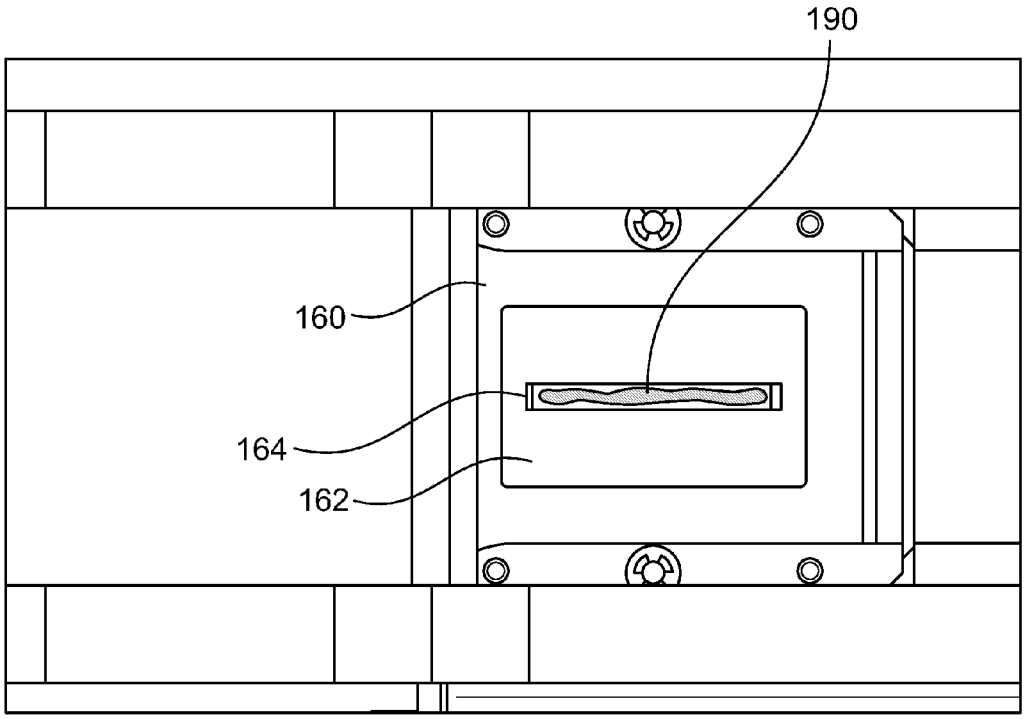
FIG. 13C is an enlarged view of the cap of FIG. 13A showing less than 100 columns ejected on a closed cap.
Figure 13D:
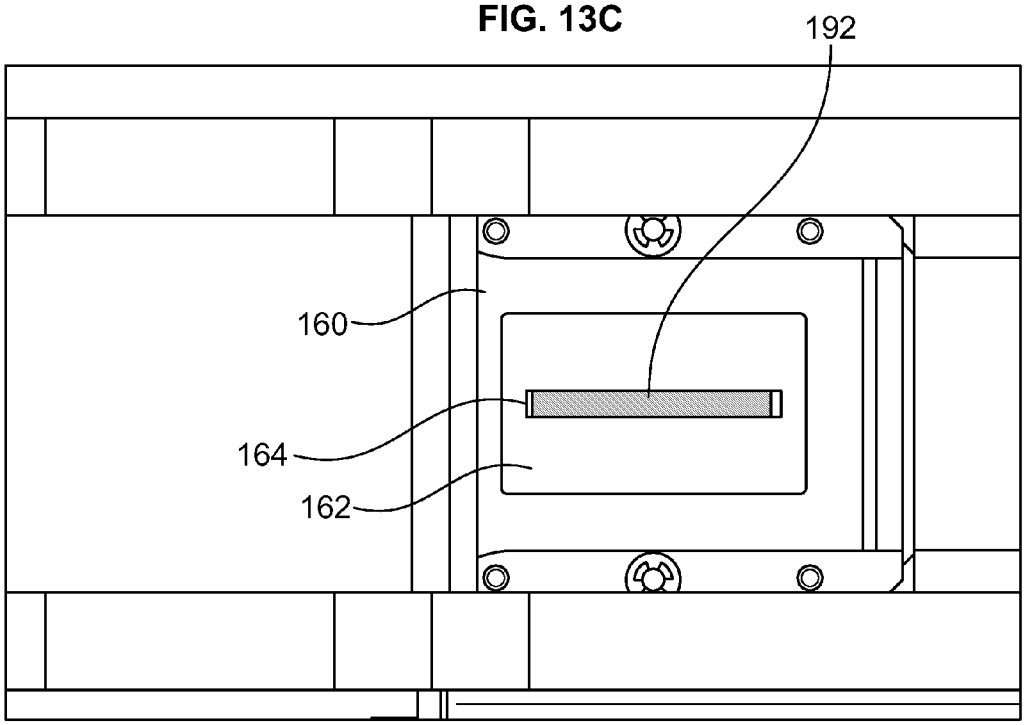
FIG. 13D is an enlarged view of the cap of FIG. 13A showing 500 columns ejected on a closed cap.

In an embodiment, the capping device 10 or 100 may use a spitting method to improve code recovery after capping. In particular, ink may be ejected from the nozzles while the cap assembly is in the closed position to provide a layer of ink between the nozzles and the surface of the cover. 'First code recovery' may be defined as the ability of a print system to print an acceptable first code after being capped for a period of time. It has been found that by ejecting or spitting ink on a closed cap after a printing operation, the ability to print codes after the cap is opened and printing is resumed (code recovery) is improved. While not intending to be bound by theory, it is believed that in the present method, the ink ejected onto the inner surface of the cap (e.g. cover 160) forms an ink layer between the nozzle orifices of the nozzle array 32 and the surface of the cap, that effectively seals the nozzle orifices and prevents the drying of ink around the orifices. The wetted surface (such as that of cover 160) is preferably formed from a material with appropriate properties (surface texture, etc.) such that the surface wets well. FIG. 13C is an enlarged view of the cap of FIG. 13A showing the ink 190 resulting from less than 100 columns ejected ('spit') on a closed cap. FIG. 13D is an enlarged view of the cap of FIG. 13A showing the ink 192 resulting from 500 columns ejected on a closed cap. It has been found that by printing on the closed cap (or 'spitting'), near 100% first code recovery can be achieved. In one embodiment, a method of using the cap includes printing around 500 columns onto the closed cap (i.e. printing through every nozzle 500 times).

It has been found that using this method of ejecting ink on a closed cap can improve the recovery from around 96% without ejecting ink to nearly 100%. Recovery results were evaluated under a variety of temperature conditions for two orientations (printing sideways and printing down) and with a cap without spitting and with spitting. The experiments used stops of varying length with the number of stops 76 per each test. For the spitting operation, the following procedure was used: once the cap was closed, 500 columns were printed onto the cap at the onset, and then the capping mechanism and print head left undisturbed, for periods of time up to 24 hours. The device was then uncapped and both text and bar code test codes were printed. The method of ejecting ink on a closed cap resulted in nearly 100% recovery of first code over a variety of temperature conditions, for both text and bar code. Additionally, no leaking of ink was observed from the system after the spitting procedure. In a further method, ink is ejected onto the cap immediately after insertion of the cartridge, before any other printing operations have begun. This can help provide a good seal around the nozzle array even before printing has begun.

Figure 22A:
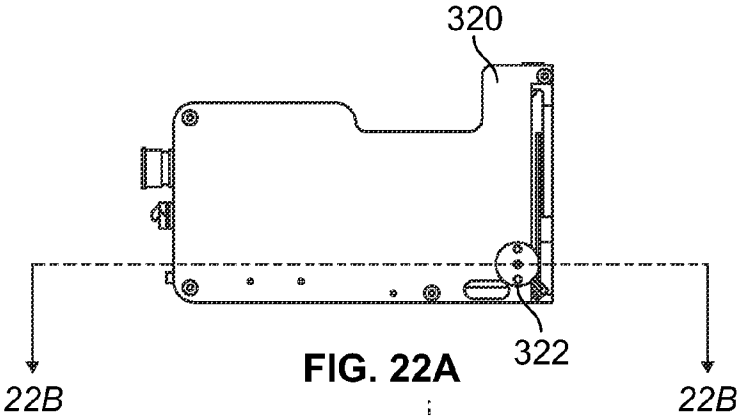
FIG. 22A is a side view of the pocket of FIG. 22.
Figure 22C:
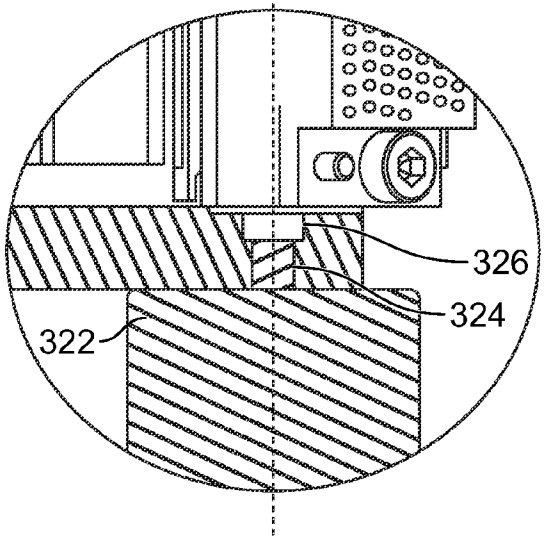
FIG. 22C is an enlarged view of detail 22C of FIG. 22B.
Figure 22:
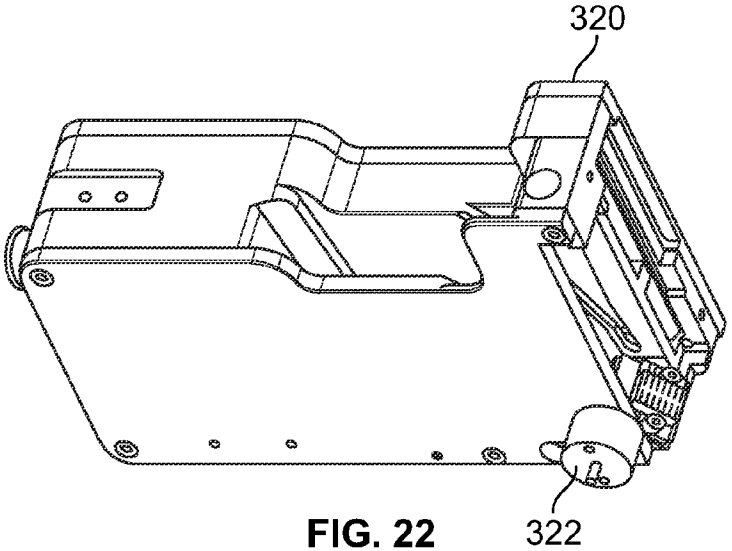
FIG. 22 is an embodiment of a pocket with an agitator.
Figure 22B:
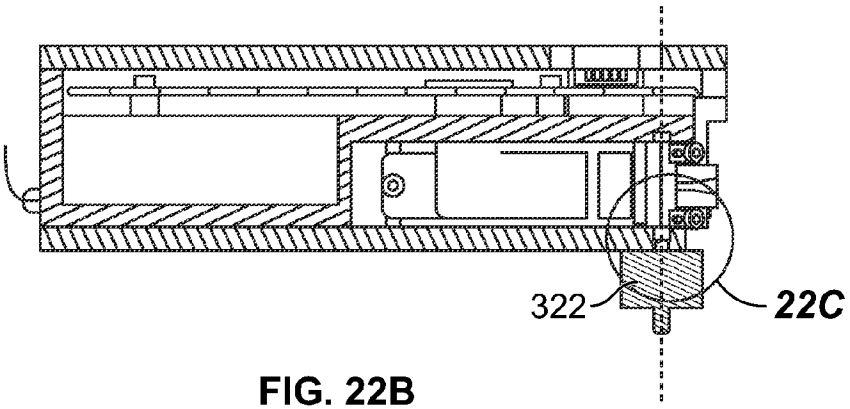
FIG. 22B is a sectional view along line B-B of FIG. 22A.

Instead of causing ink to be ejected through the normal use of the print head onto a closed cap, the ink may be mechanically ejected from a cartridge. FIG. 22 is an embodiment of a pocket or base 320 with a mechanical agitator 322. The mechanical agitator 322 may be something like a solenoid that is capable of imparting a striking force onto a portion of the print head or cartridge. Agitator 322 may include an extending pin 324 that directly contacts a portion 326 of the cartridge. In this embodiment, instead of using, for example, the resistors to thermally eject ink in the same way as is done during printing, the agitator 322 mechanical ejects ink from the print head by creating a shock wave that is transferred from the agitator to the print head. This mechanical ejection can be done instead of, or in addition to, the printing ejection. The agitator 322 is preferably located close to the chamber and orifice array of the cartridge.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A capping device for an ink jet print head, comprising:

a base, the base configured to receive an ink jet print head comprising nozzles for ejecting ink in a print direction;

a cap assembly attached to the base and configured for movement between a closed position when the print head is not printing and an open position to allow for the ejection of ink from the nozzles when the print head is printing, the cap assembly comprising:

a cover support configured for generally planar movement with respect to the base in a direction perpendicular to the print direction, the cover support comprising arms extending in a direction of the planar movement; and a cover disposed adjacent the arms and attached to the cover support in a generally planar relationship thereto, wherein the cover is adapted to provide additional movement with respect to the cover support in a direction different from the planar movement in the direction perpendicular to the print direction, and wherein the cover comprises an engagement surface configured to engage a surface of the print head adjacent the nozzles, wherein the cover is able to adjust the planar relationship between the cover and the surface of the print head.

2. The capping device of claim 1 wherein the cover support comprises rollers to provide rolling movement with respect to the base when the cover is moved between an open position and a closed position.

3. The capping device of claim 2 wherein the rollers are disposed in guide members attached to a face plate.

4. The capping device of claim 1 further comprising a cap frame attached between the cover support and the cover, wherein the cap frame comprises rollers to provide rolling movement of the cap frame with respect to the base when the cover is moved between an open position and a closed position.

5. The capping device of claim 4 further comprising a face plate providing tracks for the rollers, the tracks comprising shoulders at each end, wherein the rollers engage the shoulders to adjust the distance between the cover and the print head when the cover is moved between an open position and a closed position.

6. The capping device of claim 4 further comprising a biasing mechanism for urging the cap frame away from the nozzles of the print head.

7. The capping device of claim 6 wherein the cap frame is hingedly attached to the cover support and the biasing mechanism comprises a return spring.

8. The capping device of claim 1 wherein the cover is sufficiently dimensionally malleable to adjust the planar relationship between the cover and the surface of the print head.

9. The capping device of claim 1 wherein the engagement surface configured to engage a surface of the print head adjacent the nozzles comprises a relatively flexible layer adjacent a relatively rigid layer.

10. The capping device of claim 1 wherein the engagement surface comprises a ridge for covering an area above the nozzles of the print head.

11. The capping device of claim 1 wherein the additional movement of the cover with respect to the cover support in the direction different from the planar movement in the direction perpendicular to the print direction is generally perpendicular to the planar movement.

12. The capping device of claim 1 wherein the additional movement of the cover with respect to the cover support in the direction different from the planar movement in the direction perpendicular to the print direction is a rotational movement and the displacement of the cover with respect to the print head is less than 0.05 inches in the print direction.

13. The capping device of claim 1 wherein the cover is disposed parallel to the surface of the print head when the cap assembly is the open position and when the cap assembly is in the closed position, and the cover is angled at an angle at least 1° and less than 3° with respect to the surface of the print head when the cap assembly is in an intermediate position between the open position and the closed position.

14. The capping device of claim 1 wherein the cover is attached to the cover support by at least one spring.

15. The capping device of claim 1 wherein the capping device is configured to allow the print head to eject ink from the nozzles while the cap assembly is in the closed position to provide a layer of ink between the nozzles and the engagement surface of the cover.

16. The capping device of claim 1 further comprising a wiper extending from an end of the cover and configured to wipe an area of the print head adjacent the nozzles.

17. The capping device of claim 16 wherein the wiper comprises a flexible strip.

18. The capping device of claim 16 wherein the wiper is between 0.1 inch and 0.5 in width and 0.05 inch and 0.2 in length.

19. The capping device of claim 1 wherein the ink jet print head comprises a wiper extending from a portion of the print head to wipe an area of the cover.

20. The capping device of claim 1 wherein the system includes an agitator for agitating the print head to eject ink from the nozzles while the cap assembly is in the closed position to provide a layer of ink between the nozzles and the engagement surface of the cover.

21. The capping device of claim 20 wherein the agitator comprises a solenoid.

22. The capping device of claim 20 wherein the agitator comprises a piezoelectric device.

23. The capping device of claim 20 wherein the agitator comprises a portion for directly contacting a surface of the ink jet print head.

24. A capping device for an ink jet print head, comprising:

a base, the base configured to receive an ink jet print head comprising nozzles for ejecting ink in a print direction;

a cap assembly attached to the base and configured for movement between a closed position when the print head is not printing and an open position to allow for the ejection of ink from the nozzles when the print head is printing, the cap assembly comprising:

a cover support configured for generally planar sliding movement with respect to the base in a direction perpendicular to the print direction; and a cover attached to the cover support in a generally planar relationship thereto, wherein the cover is adapted to provide additional movement with respect to the cover support in a direction different from the planar movement in the direction perpendicular to the print direction, and wherein the cover comprises an engagement surface configured to engage a surface of the print head adjacent the nozzles, wherein the cover is sufficiently dimensionally malleable to adjust the planar relationship between the cover and the surface of the print head.

25. The capping device of claim 24 wherein the engagement surface comprises a relatively flexible surface configured to engage the nozzles on top of and adjacent to a relatively rigid surface.

26. The capping device of claim 24 wherein the engagement surface comprises a relatively rigid surface configured to engage the nozzles on top of and adjacent to a relatively flexible surface.

27. The capping device of claim 24 wherein the engagement surface comprises an elastic material comprising open cavities disposed therein, such that the elastic material is able to compress to provide in part the dimensional malleability of the cover.

28. The capping device of claim 24 wherein the cover comprises a resilient material in the shape of a perimeter around a nozzle area of the print head to provide in part the dimensional malleability of the cover.

29. The capping device of claim 1 wherein the cover comprises a rigid engagement surface comprising extending protrusions corresponding to an area adjacent a nozzle array of the print head.

30. The capping device of claim 29 wherein the rigid engagement surface is generally rectangular in shape and the protrusions are disposed in corners of the rigid engagement surface.

31. A capping device for an ink jet print head, comprising:

a base, the base configured to receive an ink jet print head comprising nozzles for ejecting ink in a print direction;

a cap assembly attached to the base and configured for movement between a closed position when the print head is not printing and an open position to allow for the ejection of ink from the nozzles when the print head is printing, the cap assembly comprising:

a cover support configured for generally planar movement with respect to the base in a direction perpendicular to the print direction; and a cover attached to the cover support in a generally planar relationship thereto, wherein the cover is adapted to provide additional movement with respect to the cover support in a direction different from the planar movement in the direction perpendicular to the print direction, and wherein the cover comprises an engagement surface configured to engage a surface of the print head adjacent the nozzles, wherein the cover is able to adjust the planar relationship between the cover and the surface of the print head, and further wherein the cover is disposed parallel to the surface of the print head when the cap assembly is the open position and when the cap assembly is in the closed position, and the cover is angled at an angle at least 1° and less than 3° with respect to the surface of the print head when the cap assembly is in an intermediate position between the open position and the closed position.

* * * * *